US011790821B2

(12) United States Patent
Zhu et al.

(10) Patent No.: US 11,790,821 B2
(45) Date of Patent: Oct. 17, 2023

(54) DRIVING CONTROL CIRCUIT FOR DETECTING POWER-DOWN TIME PERIOD, DRIVING CONTROL METHOD, AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Lixin Zhu, Beijing (CN); Chunyang Nie, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 65 days.

(21) Appl. No.: 16/760,175

(22) PCT Filed: Oct. 25, 2019

(86) PCT No.: PCT/CN2019/113288
§ 371 (c)(1),
(2) Date: Apr. 29, 2020

(87) PCT Pub. No.: WO2020/083379
PCT Pub. Date: Apr. 30, 2020

(65) Prior Publication Data

US 2021/0225236 A1 Jul. 22, 2021

(30) Foreign Application Priority Data

Oct. 26, 2018 (CN) ..... 201811257764.3

(51) Int. Cl.
*G09G 3/20* (2006.01)

(52) U.S. Cl.
CPC ..... *G09G 3/20* (2013.01); *G09G 2330/027* (2013.01)

(58) Field of Classification Search
CPC ..... G09G 3/20; G09G 2330/027; G09G 2330/021; G09G 2330/026
See application file for complete search history.

(56) References Cited

U.S. PATENT DOCUMENTS 10,481,184 B2 11/2019 Urakawa et al.
10,530,171 B2 1/2020 Li
(Continued)

FOREIGN PATENT DOCUMENTS

CN 101383129 A 3/2009
CN 201523320 U 7/2010
(Continued)

OTHER PUBLICATIONS

Jan. 2, 2020—(CN) First Office Action Appn 201811257764.3 with English Translation.

*Primary Examiner* — William Boddie
*Assistant Examiner* — Andrew B Schnirel
(74) *Attorney, Agent, or Firm* — Banner & Witcoff, Ltd.

(57) ABSTRACT

A driving control circuit, a driving control method, and a display device are disclosed. The driving control circuit includes an input terminal, a power-down time acquisition circuit, an output terminal, and a switch circuit. The input terminal is configured to receive an input voltage; the power-down time acquisition circuit is configured to detect a power-down time period required for the input voltage to decrease to a lowest voltage, the power-down time period is used to generate a switch control signal; the output terminal is configured to output a voltage; and the switch circuit is configured to receive the input voltage and determine, according to the switch control signal, whether to be turned
(Continued)

on to transmit the input voltage to the output terminal for output.

14 Claims, 12 Drawing Sheets

(56) References Cited

U.S. PATENT DOCUMENTS

| | | | | |
|---|---|---|---|---|
| 11,393,395 | B2 * | 7/2022 | Kim | G09G 3/3233 |
| 2003/0020676 | A1 * | 1/2003 | Lin | G09G 3/3611 345/87 |
| 2006/0133181 | A1 * | 6/2006 | Amano | G11C 5/141 365/229 |
| 2009/0231253 | A1 * | 9/2009 | Hu | G09G 3/3648 345/87 |
| 2014/0062447 | A1 | 3/2014 | Chen | |
| 2014/0092144 | A1 * | 4/2014 | Kim | G09G 3/3233 345/76 |
| 2015/0179128 | A1 * | 6/2015 | Huang | G11C 19/28 327/109 |
| 2017/0243558 | A1 * | 8/2017 | Yamamoto | G09G 3/3677 |
| 2018/0053463 | A1 * | 2/2018 | Kong | G09G 3/20 |
| 2019/0057668 | A1 * | 2/2019 | Xiong | G09G 3/3696 |
| 2019/0221183 | A1 * | 7/2019 | Hou | G09G 3/3696 |

FOREIGN PATENT DOCUMENTS

| | | | |
|---|---|---|---|
| CN | 106329898 | A | 1/2017 |
| CN | 106373526 | A | 2/2017 |
| CN | 107850628 | A | 3/2018 |
| CN | 108054724 | A | 5/2018 |
| CN | 109215559 | A | 1/2019 |

* cited by examiner

DRIVING CONTROL CIRCUIT FOR DETECTING POWER-DOWN TIME PERIOD, DRIVING CONTROL METHOD, AND DISPLAY DEVICE

CROSS REFERENCE TO RELATED APPLICATIONS

The application is a U.S. National Phase Entry of International Application No. PCT/CN2019/113288 filed on Oct. 25, 2019, designating the United States of America and claiming priority to Chinese Patent Application No. 201811257764.3, filed on Oct. 26, 2018. The present application claims priority to and the benefit of the above-identified applications and the above-identified applications are incorporated by reference herein in their entirety.

TECHNICAL FIELD

The embodiments of the present disclosure relate to a driving control circuit, a driving control method, and a display device.

BACKGROUND

With the development of display technology and the improvement of living standards, users have put forward higher requirements for the performance and service life of display panels in special use environments (e.g., high temperature, low temperature, high humidity) and in a case where the power supply is abnormally powered off and then powered on again.

SUMMARY

At least one embodiment of the present disclosure provides a driving control circuit, and the driving control circuit comprises: an input terminal, a power-down time acquisition circuit, an output terminal, and a switch circuit. The input terminal is configured to receive an input voltage; the power-down time acquisition circuit is configured to detect a power-down time period required for the input voltage to decrease to a lowest voltage, the power-down time period is used to generate a switch control signal; the output terminal is configured to output a voltage; and the switch circuit is configured to receive the input voltage and determine, according to the switch control signal, whether to be turned on to transmit the input voltage to the output terminal for output.

For example, in at least one example of the driving control circuit, the power-down time acquisition circuit is configured to detect the power-down time period required for the input voltage to decrease from a threshold voltage to the lowest voltage.

For example, in at least one example of the driving control circuit, the driving control circuit further comprises a first comparison circuit, the first comparison circuit is configured to compare the input voltage with the threshold voltage to obtain a voltage comparison result, and the voltage comparison result comprise a first voltage comparison result in a case where the input voltage is less than the threshold voltage and a second voltage comparison result in a case where the input voltage is greater than or equal to the threshold voltage.

For example, in at least one example of the driving control circuit, the driving control circuit further comprises a second comparison circuit, the second comparison circuit is configured to compare the power-down time period with a threshold power-down time period to obtain a power-down time comparison result, and the power-down time comparison result comprises a first power-down time comparison result in a case where the power-down time period is less than the threshold power-down time period and a second power-down time comparison result in a case where the power-down time period is greater than or equal to the threshold power-down time period.

For example, in at least one example of the driving control circuit, the driving control circuit further comprises a judgment circuit, the judgment circuit generates the switch control signal according to the voltage comparison result and the power-down time comparison result.

For example, in at least one example of the driving control circuit, the judgment circuit is configured to generate, according to the first voltage comparison result and the first power-down time comparison result, a first switch control signal to turn off the switch circuit, and generate, according to the second voltage comparison result or the second power-down time comparison result, a second switch control signal to turn on the switch circuit.

For example, in at least one example of the driving control circuit, the power-down time acquisition circuit is configured to be triggered by the first voltage comparison result to detect the power-down time period.

For example, in at least one example of the driving control circuit, the driving control circuit further comprises a voltage sensing circuit, the voltage sensing circuit is configured to sense a voltage value of the input voltage, and provide the voltage value that is sensed to the power-down time acquisition circuit.

For example, in at least one example of the driving control circuit, the voltage sensing circuit is further configured to provide the voltage value that is sensed to the first comparison circuit, and the first comparison circuit compares the voltage value and a pre-stored value of the threshold voltage.

For example, in at least one example of the driving control circuit, the driving control circuit further comprises a threshold voltage generation circuit, the threshold voltage generation circuit is configured to generate the threshold voltage, a first terminal of the first comparison circuit is configured to receive the input voltage; and a second terminal of the first comparison circuit is configured to receive the threshold voltage.

For example, in at least one example of the driving control circuit, the power-down time acquisition circuit comprises a lowest point determination circuit and a time calculation circuit; the lowest point determination circuit is configured to determine a transition point of the input voltage from negative change to positive change as the lowest voltage, and to output a first time period required for the input voltage to decrease to the lowest voltage; and the time calculation circuit is configured to read a second time period required for the input voltage to decrease to the threshold voltage, and calculate the power-down time period based on the first time period and the second time period.

For example, in at least one example of the driving control circuit, the driving control circuit further comprises a first comparison circuit, a second comparison circuit, and a judgment circuit. the power-down time acquisition circuit is configured to detect the power-down time period required for the input voltage to decrease from a threshold voltage to the lowest voltage; the first comparison circuit is configured to compare the input voltage with the threshold voltage to obtain a voltage comparison result, and the voltage comparison result comprises a first voltage comparison result in a case where the input voltage is less than the threshold voltage and a second voltage comparison result in a case where the input voltage is greater than or equal to the threshold voltage; the second comparison circuit is configured to compare the power-down time period with a threshold power-down time period to obtain a power-down time comparison result, and the power-down time comparison result comprises a first power-down time comparison result in a case where the power-down time is less than the threshold power-down time and a second power-down time comparison result in a case where the power-down time is greater than or equal to the threshold power-down time; and the judgment circuit is configured to generate, according to the first voltage comparison result and the first power-down time comparison result, a first switch control signal to turn off the switch circuit, and generate, according to the second voltage comparison result or the second power-down time comparison result, a second switch control signal to turn on the switch circuit.

For example, in at least one example of the driving control circuit, the driving control circuit further comprises a second comparison circuit, the second comparison circuit is configured to compare the power-down time period with a threshold power-down time period to obtain a power-down time comparison result, and the power-down time comparison result comprises a first power-down time comparison result in a case where the power-down time period is less than the threshold power-down time period and a second power-down time comparison result in a case where the power-down time period is greater than or equal to the threshold power-down time period. The second comparison circuit is further configured to output a first switch control signal to turn off the switch circuit in a case where the first power-down time comparison result is obtained, and to output a second switch control signal to turn on the switch circuit in a case where the second power-down time comparison result is obtained.

At least one embodiment of the present disclosure also provides a driving control method, and the driving control method comprises: receiving an input voltage; detecting a power-down time period required for the input voltage to decrease to a lowest voltage, the power-down time period being used to generate a switch control signal; and determining, according to the switch control signal, whether to turn on a switch circuit to transmit the input voltage to an output terminal for output.

For example, in at least one example of the driving control method, the power-down time period is a power-down time period required for the input voltage to decrease from a threshold voltage to the lowest voltage.

For example, in at least one example of the driving control method, the driving control method further comprises: comparing the input voltage with the threshold voltage, and generating a first voltage comparison result in a case where the input voltage is less than the threshold voltage, and generating a second voltage comparison result in a case where the input voltage is greater than or equal to the threshold voltage.

For example, in at least one example of the driving control method, the driving control method further comprises: comparing the power-down time period with a threshold power-down time period, generating a first power-down time comparison result in a case where the power-down time period is less than the threshold power-down time period, and generating a second power-down time comparison result in a case where the power-down time period is greater than or equal to the threshold power-down time period.

For example, in at least one example of the driving control method, the driving control method further comprises: generating a first switch control signal according to the first voltage comparison result and the first power-down time comparison result to turn off the switch circuit, and generating a second switch control signal according to the second voltage comparison result or the second power-down time comparison result to turn on the switch circuit.

For example, in at least one example of the driving control method, in a case where the first voltage comparison result is generated, a detection of the power-down time period is performed again.

At least one embodiment of the present disclosure also provides a display device, and the display device comprises the driving control circuit provided by any embodiment of the present disclosure.

For example, in at least one example of the display device, the display device further comprises a display panel and a power supply providing the input voltage, the input terminal of the driving control circuit is connected to the power supply, and the output terminal of the driving control circuit is connected to the display panel.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

FIG. 1C is a change curve of an input voltage over time in a case where a display device is powered off and then quickly powered on;

FIG. 2A is a schematic diagram of a test result in a case where a display device is powered off and then quickly powered on;

FIG. 2B is a schematic diagram of another test result in a case where a display device is powered off and then quickly powered on;

FIG. 3B is a change curve of an input voltage over time in a case where the display device illustrated in FIG. 3A is powered off and then quickly powered on;

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1A:
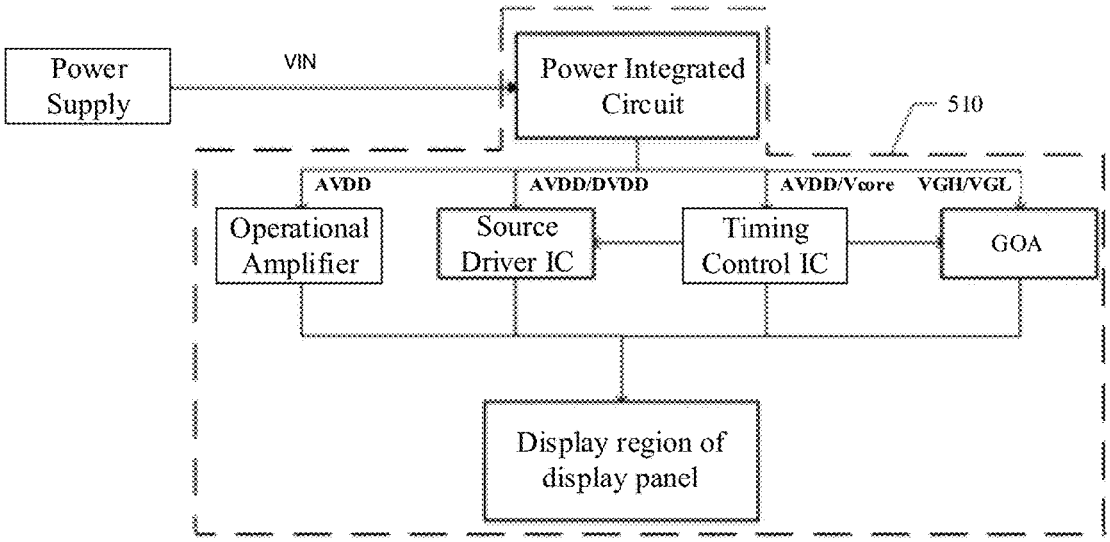
FIG. 1A is a schematic block diagram of a display device.

FIG. 1A is a schematic block diagram of a display device. As illustrated in FIG. 1A, the display device includes a power supply and a display panel 510. The display panel 510 includes a power integrated circuit, an operational amplifier, a source driver integrated circuit (IC), a timing control integrated circuit, a gate driver circuit (GOA) integrated on an array substrate, and a display region (or a display array). The power supply is, for example, a direct current power supply, is connected to the power integrated circuit of the display panel, and provides an input voltage VIN to the power integrated circuit. The input voltage VIN is, for example, 12V. The power integrated circuit is connected with the operational amplifier, the source driver IC, and the timing control IC, and provides the required driving voltages (AVDD, DVDD, Vcore) to the operational amplifier, the source driver IC, and the timing control IC, respectively. The power integrated circuit is also connected to the GOA, and can provide a first level (VGH) and a second level (VGL) to the GOA, and a voltage value of the first level is greater than a voltage value of the second level.

Figure 1B:
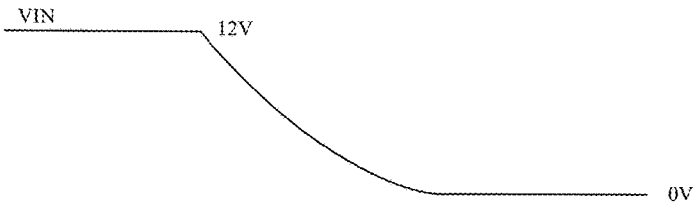
FIG. 1B is a change curve of an input voltage over time in a case where a display device is normally powered off.
Figure 1C:
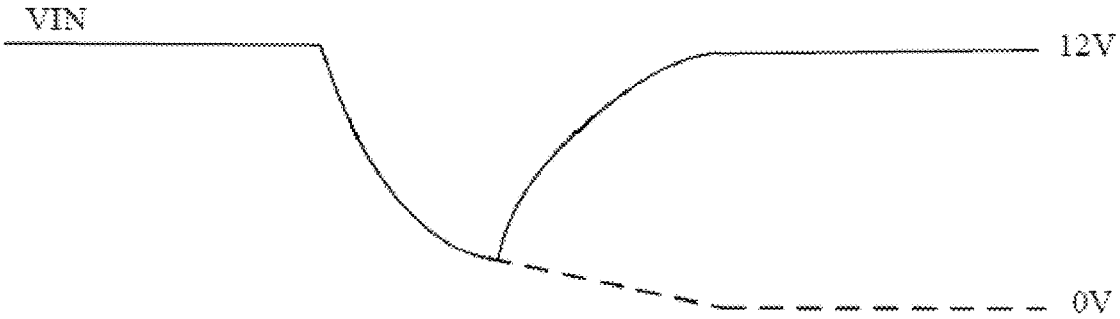

FIG. 1B illustrates a change curve of the input voltage VIN over time in a case where the display device is normally powered off. As illustrated in FIG. 1B, in a case where the display device is normally powered off, the input voltage VIN output from the power supply and transmitted to the power integrated circuit will gradually power down to zero volts (for example, power down from 12V to 0V). However, in the case where the display device is powered off and then quickly powered on, as illustrated in FIG. 1C, the input voltage VIN output by the power supply rises again and is in the power on state before the input voltage VIN is powered down to zero volts. The inventors of the present disclosure have noticed that in the case where the display device is powered off and then quickly powered on, the display device may have a display failure such as a black screen or a crash. Hereinafter, the present disclosure will be exemplarily described below with reference to FIGS. 2A and 2B and by taking the influence of a case that the display device is powered off and then quickly powered on the GOA as an example.

Figure 2A:
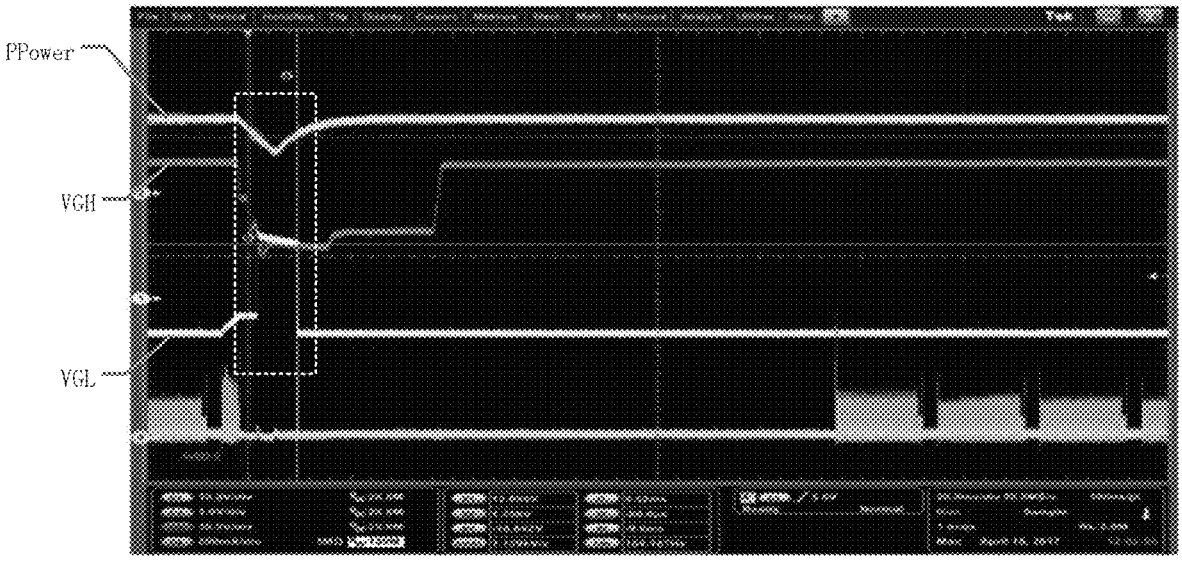
Figure 2B:
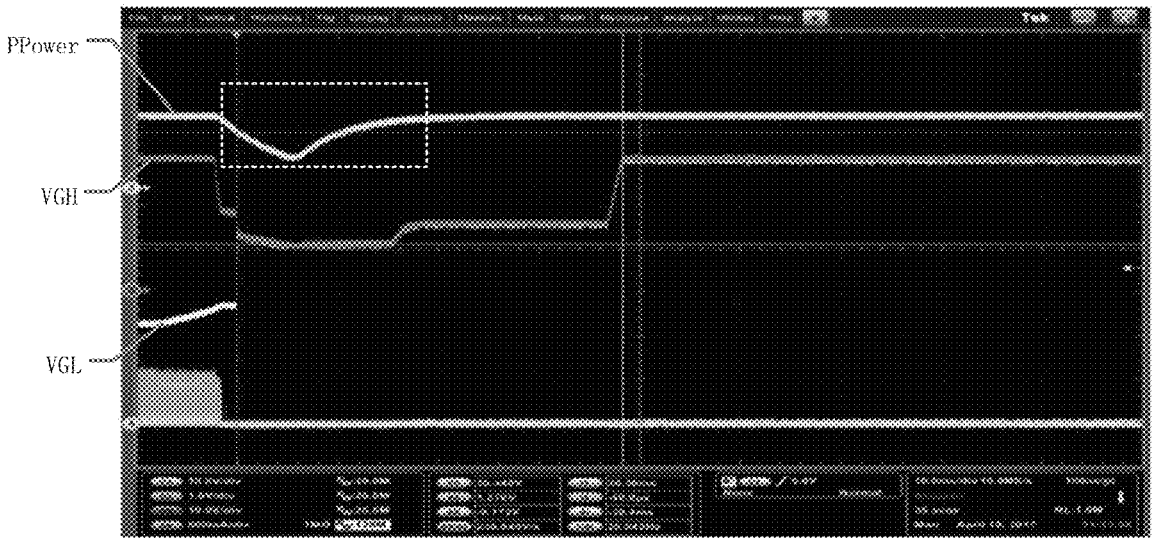

FIG. 2A illustrates a test result in a case where a display device is powered off and then quickly powered on (the time is about 10 milliseconds). In this case, the case that the display device is powered off and then quickly powered on does not result in a poor display. FIG. 2B illustrates another test result of another test result in a case where a display device is powered off and then quickly powered on (time is about 10 milliseconds). In this case, the case that the display device is powered off and then quickly powered on results in a poor display of the display device.

As illustrated in FIGS. 2A and 2B, in a case where the display device displays normally (before the display device is powered off and then quickly powered on, i.e., a time period on the left side of the dotted box in FIGS. 2A and 2B), the GOA can obtain the first level (VGH) and the second level (VGL) from the power integrated circuit. As illustrated in FIG. 2A, in a case where the display device is powered off and then quickly powered on (a voltage PPower output by the power supply is powered on again before the voltage PPower is powered down to 0V), and the case that the display device is powered off and then quickly powered on does not result in a poor display, the second level (VGL) will jump to the first level (VGH) during the time period when the display device is powered off and then quick powered on (i.e., a time period corresponding to the dotted box in FIG. 2A), and return to a normal level after the display device is powered off and then quick powered on. In this case, the display device can display normally after being powered on again. As illustrated in FIG. 2B, in a case where the case that the display device is powered off and then quickly powered on results in a poor display, the second level (VGL) will jump to the first level (VGH) during the time period when the display device is powered off and then quick powered on (i.e., a time period corresponding to the dotted box in FIG. 2B), and does not return to the normal level after the display device is powered off and then quick powered on (i.e., remains at the first level). In this case, the GOA can only obtain the first level (VGH) from the power integrated circuit, so that, for example, all the thin film transistors of the display panel may always be turned on, which will not only increase the power consumption and temperature of the display device, but also cause the display device to fail to display images normally after being powered on again (for example, a black screen or even a crash).

The embodiments of the present disclosure provide a driving control circuit, a driving control method, and a display device. The driving control circuit and the driving control method can be applied to the display device. The driving control circuit includes an input terminal, a power-down time acquisition circuit, an output terminal, and a switch circuit. The input terminal is configured to receive an input voltage; the power-down time acquisition circuit is configured to detect a power-down time period required for the input voltage to decrease to a lowest voltage, and the power-down time period is used to generate a switch control signal; the output terminal is configured to output voltage; the switch circuit is configured to receive the input voltage, and determine, according to the switch control signal, whether to be turned on to transmit the input voltage to the output terminal for output.

In some examples, in a case where the display device is powered off and then quick powered on, the driving control circuit can prevent the input voltage from being transmitted to the output terminal of the driving control circuit for output, thereby reducing the risk of poor display of the display device equipped with the driving control circuit and improving the user experience. In some examples, the driving control circuit can automatically exit a power-off and then quick power-on protection mode in a case where the input voltage returns to above the threshold voltage again, thereby improving the driving stability and further improving the user experience.

The following provides a non-limiting description of the driving control circuit provided by the embodiments of the present disclosure through several examples and embodiments. As described below, different features in these specific examples and embodiments can be combined with each other without conflicting, so as to obtain new examples, and these new examples and embodiments also fall within the protection scope of the present disclosure.

Figure 3A:
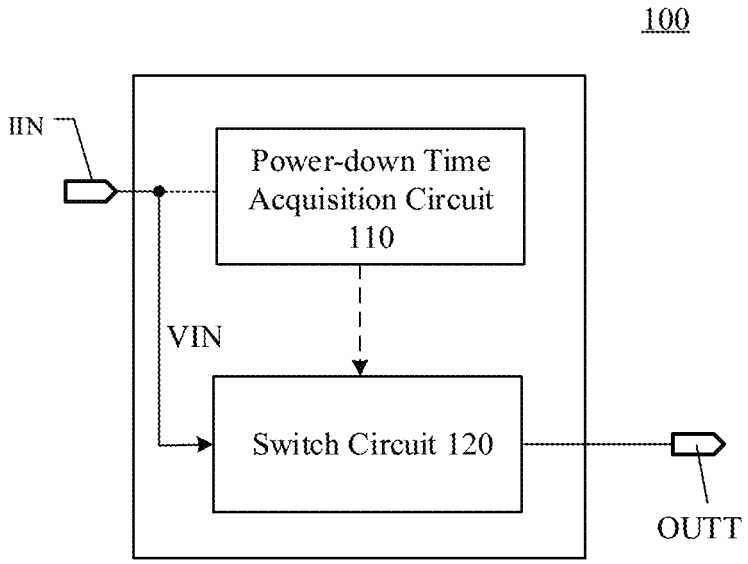
FIG. 3A is an exemplary block diagram of a driving control circuit provided by at least one embodiment of the present disclosure.

FIG. 3A is a schematic block diagram illustrating a driving control circuit 100 provided by at least one embodiment of the present disclosure. The driving control circuit 100 can be applied to a display device (for example, a display device 10 illustrated in FIG. 14, which will be described later). As illustrated in FIG. 3A, the driving control circuit 100 includes an input terminal IIN and an output terminal OUTT; the input terminal IIN of the driving control circuit 100 is connected to an output terminal of a power supply of the display device, and is configured to receive an input voltage VIN provided by the power supply; The output terminal OUTT of the driving control circuit 100 is connected to, for example, a power integrated circuit of the display device, and is configured to, in a case of no power-off and then quick power-on, provide the input voltage VIN to, for example, the power integrated circuit. In a case of power-off and then quick power-on, the driving control circuit 100 can prevent the input voltage VIN from being transmitted to the output terminal OUTT (in this case, the output terminal OUTT outputs, for example, a voltage of 0 V), thereby reducing the risk of poor display of the display device equipped with the driving control circuit 100.

As illustrated in FIG. 3A, the driving control circuit 100 further includes a power-down time acquisition circuit 110 and a switch circuit 120. An input terminal of the switch circuit 120 is electrically connected to the input terminal IIN of the driving control circuit 100, and an output terminal of the switch circuit 120 is electrically connected to the output terminal OUTT of the driving control circuit 100. As illustrated in FIG. 3A, the power-down time acquisition circuit 110 is configured to detect a power-down time period Td required for the input voltage VIN to decrease to a lowest voltage. It should be noted that the lowest voltage here refers to a minimum value that the input voltage VIN can reach during the time period when the display device is powered down and then powered on, and the lowest voltage is greater than zero volts.

Figure 3B:
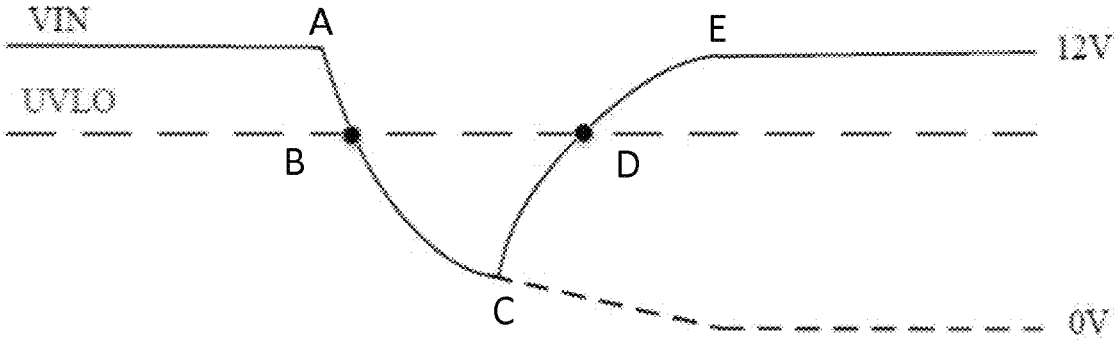

FIG. 3B is a change curve of a voltage value of the input voltage VIN over time in a case where the display device illustrated in FIG. 3A is powered off and then quickly powered on. As illustrated in FIG. 3B, first, the input voltage VIN (e.g., 12V) is reduced from a voltage corresponding to a starting point A of the power-down and then quick power-on to a threshold voltage UVLO (corresponding to a point B), and is further reduced to the lowest voltage (corresponding to a point C, a certain voltage higher than 0V), and then the input voltage VIN increases from the lowest voltage (corresponding to the point C) to the threshold voltage UVLO (corresponding to a point D), and further increases to a voltage (e.g., 12V) corresponding to an end point E of the power-down and then quick power-on.

For example, in a case where the voltage value of the input voltage VIN is greater than or equal to the threshold voltage UVLO (for example, about 8.5V), the power integrated circuit normally provides various driving voltages (for example, AVDD, DVDD, Vcore, VGH, and VGL). In a case where the voltage value of the input voltage VIN is less than the threshold voltage UVLO, the power integrated circuit does not provide various driving voltages. Therefore, in a case where the re-power-on process occurs when the voltage value of the input voltage VIN is greater than or equal to the threshold voltage UVLO, the risk of poor display due to the re-power-on process is low; however, in a case where the re-power-on process occurs when the voltage value of the input voltage VIN is less than the threshold voltage UVLO, the re-power-on process may cause poor display.

Based on this, the power-down time acquisition circuit 110 may be configured to detect the power-down time period Td required for the input voltage VIN to decrease from the threshold voltage UVLO (i.e., the point B) to the lowest voltage (i.e., the point C). In this example and other examples of the embodiments of the present disclosure, the power-down time acquisition circuit 110 is configured to detect the power-down time period Td required for the input voltage VIN to decrease from the threshold voltage UVLO to the lowest voltage, but the embodiments of the present disclosure are not limited thereto. In some examples, the power-down time acquisition circuit 110 may also be configured to detect a time period required for the input voltage VIN to decrease from the voltage at a starting moment of the power-down and then quick power-on to the lowest voltage as the power-down time period. Correspondingly, the power-down time period is the time period required for the input voltage VIN to decrease from the voltage at the starting moment of the power-down and then quick power-on or the threshold voltage UVLO to the lowest voltage. It should be noted that the power-down time period in other embodiments or examples of the present disclosure may also have a similar definition, and will not be described in detail.

Figure 4A:
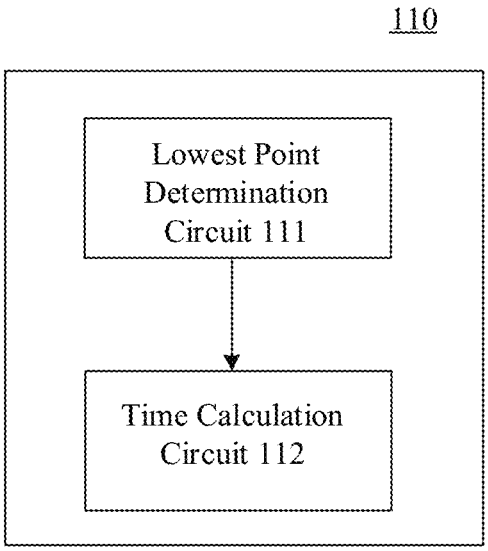
FIG. 4A is an exemplary block diagram of a power-down time acquisition circuit provided by at least one embodiment of the present disclosure.

FIG. 4A is an exemplary block diagram illustrating the power-down time acquisition circuit 110 provided by at least one embodiment of the present disclosure. As illustrated in FIG. 4A, the power-down time acquisition circuit 110 includes a lowest point determination circuit 111 and a time calculation circuit 112. The lowest point determination circuit 111 is configured to determine a transition point (i.e., a point C) of the input voltage VIN from negative change (the value of the input voltage VIN gradually decreases) to positive change (that is, the value of the input voltage VIN gradually increases) as the lowest voltage, and to output a first time period required for the input voltage VIN to decrease to the lowest voltage. For example, the lowest point determination circuit 111 may determine the transition point of the input voltage VIN from the negative change to the positive change by detecting a change speed v of the input voltage VIN.

Figure 4B:
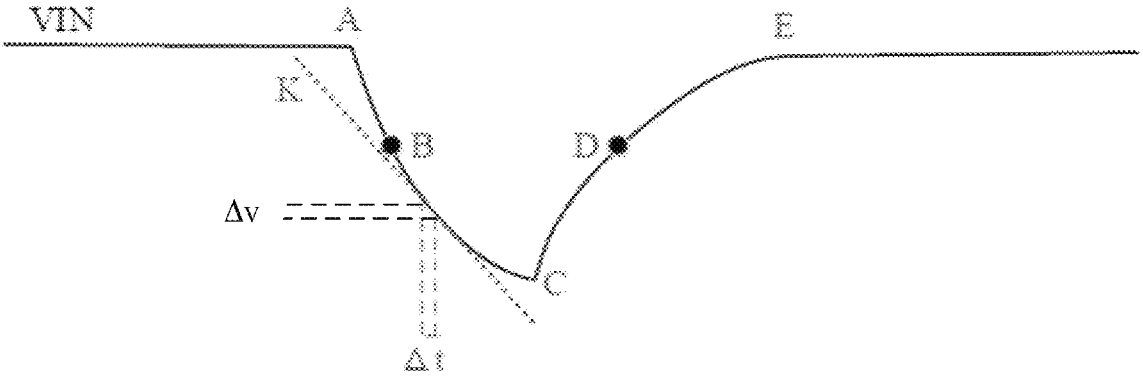
FIG. 4B is an exemplary diagram illustrating an exemplary method for obtaining a change speed of the input voltage by the power-down time acquisition circuit illustrated in FIG. 4A.

FIG. 4B illustrates an exemplary method for obtaining a change speed v of the input voltage VIN by the power-down time acquisition circuit illustrated in FIG. 4A. For example, as illustrated in FIG. 4B, the change speed of the input voltage VIN can be calculated as $v=\Delta v/\Delta t$, where $\Delta v$ is an amount of change in the voltage value of the input voltage VIN within $\Delta t$ time. For example, in a case where the value of $\Delta t$ is at a level of milliseconds (for example, 1 millisecond to 9 milliseconds), $\Delta v$ may be used as the change speed v of the input voltage VIN (i.e., a slope K of the input voltage VIN).

Figure 4C:
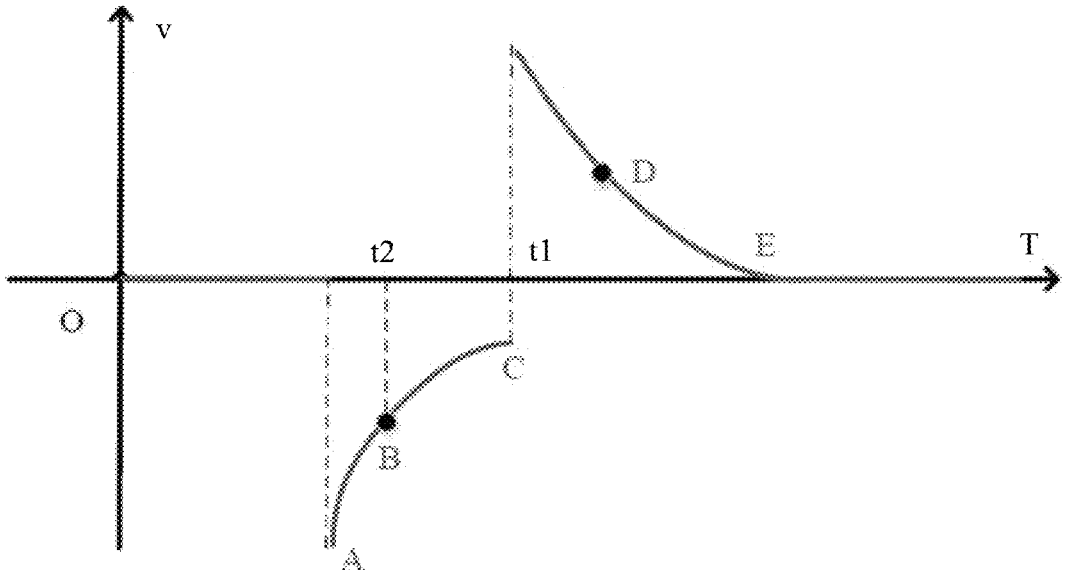
FIG. 4C is a schematic diagram illustrating a curve showing the change speed of the input voltage illustrated in FIG. 4B over time.

FIG. 4C illustrates a curve showing the change speed v of the input voltage VIN illustrated in FIG. 4B over time. As illustrated in FIG. 4C, at the transition point (i.e., the point C) of the power-down and then quick power-on, the change speed v of the input voltage VIN jumps from a negative value to a positive value. Therefore, in a case where the lowest point determination circuit 111 detects that the change speed v of the input voltage VIN jumps from a negative value to a positive value, the lowest point determination circuit 111 may determine a value of the input voltage VIN corresponding to a negative value at the last moment (i.e., the point C or the transition point) before the change speed v of the input voltage VIN jumps to a positive value as the lowest voltage, and may output a first time period t1 required for the input voltage VIN to decrease to the lowest voltage (i.e., the voltage corresponding to the point C).

For example, the time calculation circuit 112 is configured to receive the first time period t1, which is output by the lowest point determination circuit 111, required for the input voltage VIN to decrease to the lowest voltage, and the time calculation circuit 112 is further configured to read a second time period t2 required for the input voltage VIN to decrease to the threshold voltage UVLO (referring to FIG. 4C), for example, the time calculation circuit 112 is configured to detect the second time period t2 required for the input voltage VIN to decrease to the threshold voltage UVLO from the voltage at the starting moment of the power-down and then quick power-on, so that the time calculation circuit 112 may calculate the power-down time period Td based on the first time period t1 and the second time period t2. For example, the time calculation circuit 112 may receive a clock signal, determine the relative first time period t1 and the relative second time period t2 through the clock signal, and thereby calculate the power-down time period Td.

Figure 5:
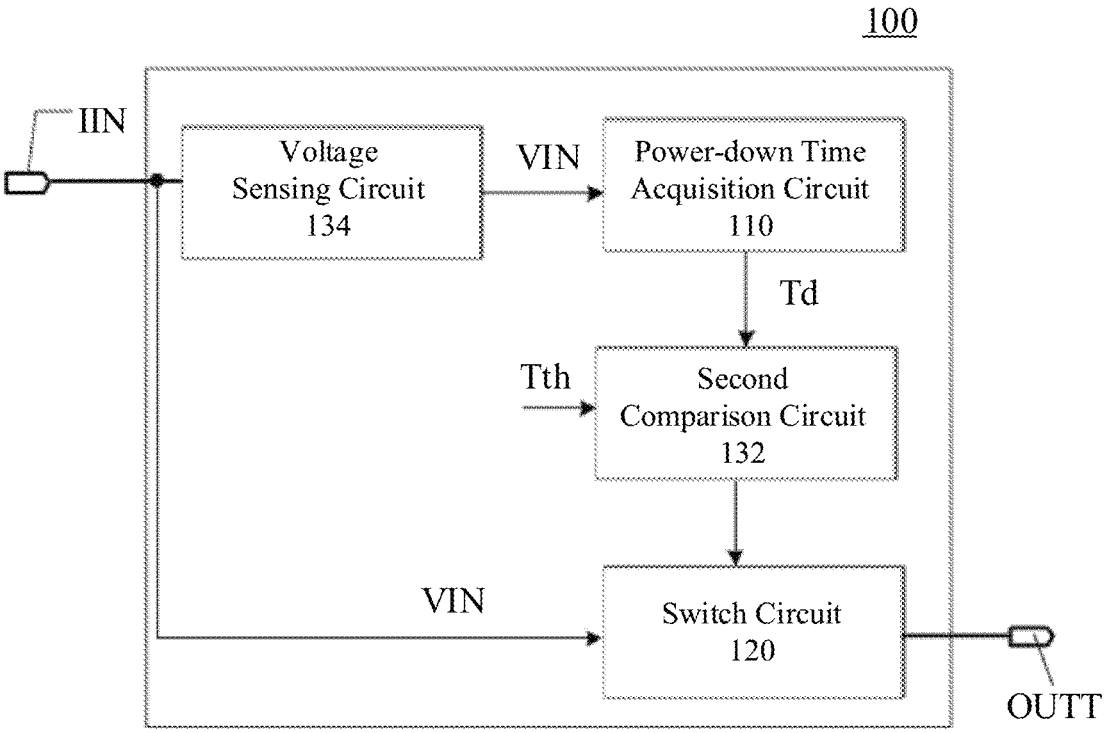
FIG. 5 is an exemplary block diagram of another driving control circuit provided by at least one embodiment of the present disclosure.

FIG. 5 is a schematic block diagram illustrating another driving control circuit 100 provided by an embodiment of the present disclosure. The driving control circuit 100 illustrated in FIG. 5 is similar to the driving control circuit 100 illustrated in FIG. 3A. As illustrated in FIG. 5, compared to the driving control circuit 100 illustrated in FIG. 3A, the driving control circuit 100 illustrated in FIG. 5 further includes a voltage sensing circuit 134 and a second comparison circuit 132. The voltage sensing circuit 134 provides the voltage value that is sensed to the power-down time acquisition circuit 110. In this case, there is no need to provide a voltage sensing circuit in the power-down time acquisition circuit 110. For example, the voltage sensing circuit 134 may be configured as a voltage sampling circuit.

For example, the second comparison circuit 132 may be a comparator or an operational amplifier. As illustrated in FIG. 5, a first terminal of the second comparison circuit 132 is configured to be connected to the power-down time acquisition circuit 110 to receive the power-down time period Td provided by the power-down time acquisition circuit 110.

As illustrated in FIG. 5, a second terminal of the second comparison circuit 132 is configured to receive a threshold power-down time period Tth. For example, the threshold power-down time period Tth may be stored in a memory or a register in advance, and then read into the second comparison circuit 132. For example, the threshold power-down time period Tth may be set based on the product characteristics (e.g., size, resolution, material, etc.) of the display device, and the embodiments of the present disclosure do not specifically limit the threshold power-down time period Tth. For example, in the case where the display device is a TV, if the time when the display device is powered off and then quickly powered on (i.e., the time when the input voltage VIN changes from the point B to the point C) is less than 1 second, the display device may have the poor display. In this case, the threshold power-down time period Tth can be set to 0.4-0.6 seconds (e.g., 0.5 seconds).

As illustrated in FIG. 5, the second comparison circuit 132 is configured to compare the power-down time period Td with the threshold power-down time period Tth to obtain a power-down time comparison result. For example, the power-down time comparison result includes a first power-down time comparison result in a case where the power-down time period Td is less than the threshold power-down time period Tth (in this case, it is considered to be in a power-off and then quick power-on state) and a second power-down time comparison result in a case where the power-down time period Td is greater than or equal to the threshold power-down time period Tth. An output terminal of the second comparison circuit 132 is configured to output a switch control signal, and the switch control signal is provided to the switch circuit 120. In a case where the power-down time comparison result is the first power-down time comparison result, the output terminal of the second comparison circuit 132 is configured to output a first switch signal (i.e., a first switch control signal) to turn off the switch circuit 120; In a case where the power-down time comparison result is the second power-down time comparison result, the output terminal of the second comparison circuit 132 is configured to output a second switch signal (i.e., a second switch control signal) to turn on the switch circuit 120.

As illustrated in FIG. 5, the switch circuit 120 is connected to the input terminal IIN to receive the input voltage VIN; a control terminal of the switch circuit 120 is connected to the output terminal of the second comparison circuit 132 to receive the switch control signal output by the second comparison circuit 132; an output terminal of the switch circuit 120 is configured as the output terminal OUTT of the driving control circuit; the switch circuit 120 is configured to determine, according to the switch control signal, whether to be turned on to transmit the input voltage VIN to the output terminal OUTT of the driving control circuit for output.

For example, in a case where the control terminal of the switch circuit 120 receives the first switch signal, the switch circuit 120 is turned off. In this case, the input voltage VIN received by the input terminal IIN of the driving control circuit cannot be transmitted to the output terminal OUTT of the driving control circuit, and therefore cannot be output from the output terminal OUTT of the driving control circuit. For another example, in a case where the control terminal of the switch circuit 120 receives the second switch signal, the switch circuit 120 is turned on. In this case, the input voltage VIN received by the input terminal IIN of the driving control circuit can be transmitted to the output terminal OUTT of the driving control circuit and can be output.

For example, the switch circuit 120 may be a triode, a transistor, or the like. For example, a gate electrode of the transistor is connected to the output terminal of the second comparison circuit 132, a first electrode of the transistor (e.g., a source electrode of the transistor) is connected to the input terminal IIN of the driving control circuit, and a second electrode of the transistor (e.g., a drain electrode of the transistor) is configured as the output terminal OUTT of the driving control circuit. For example, the switch circuit 120 may be a metal-oxide-semiconductor field-effect transistor (i.e., MOS transistor). For example, the switch circuit 120 may be an N-type transistor. In this case, a switch control signal for turning off the switch circuit 120 is a low-level signal, and a switch control signal for turning on the switch circuit 120 is a high-level signal.

For example, in some examples, by detecting the power-down time period Td through the power-down time acquisition circuit 110, and generating the first switch control signal for turning off the switch circuit 120 in a case where the power-down time period Td is less than the threshold power-down time period Tth, the risk of poor display can be reduced in a case where the display device equipped with the driving control circuit 100 provided by the embodiments of the present disclosure is powered off and then quickly powered on, thereby improving the user experience.

Figure 6A:
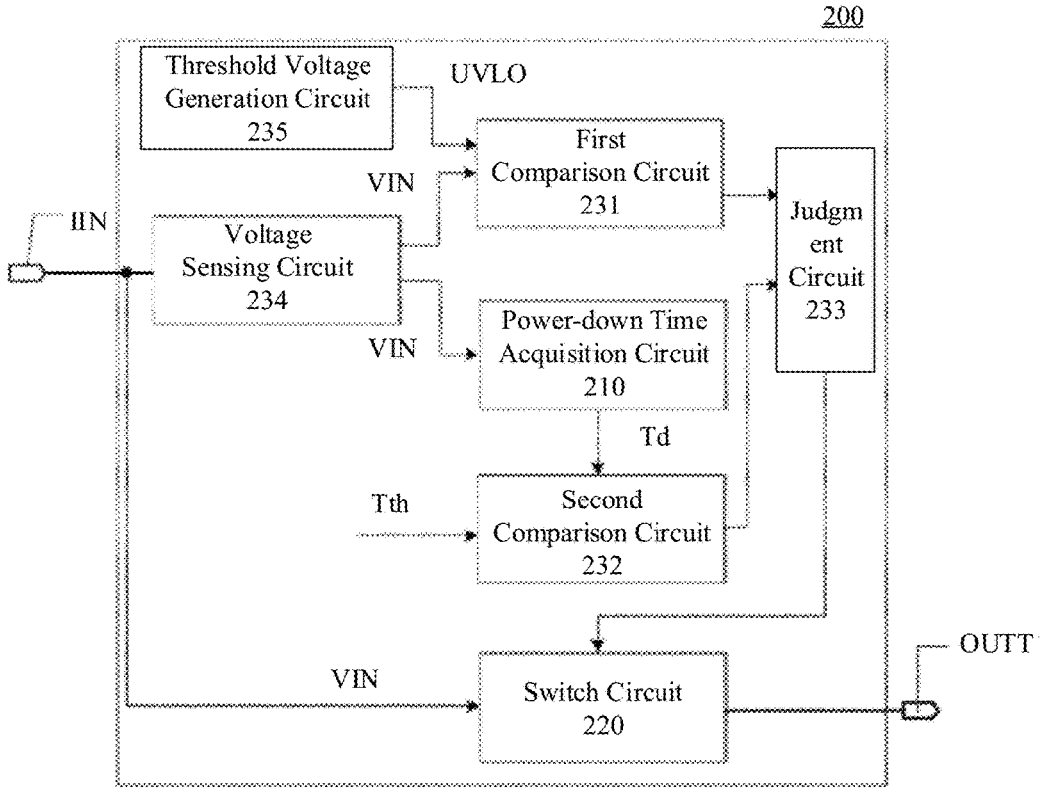
FIG. 6A is an exemplary block diagram of yet another driving control circuit provided by at least one embodiment of the present disclosure.

FIG. 6A is a schematic block diagram illustrating yet another driving control circuit 200 provided by an embodiment of the present disclosure. The driving control circuit 200 can be applied to a display device (e.g., the display device illustrated in FIG. 14). As illustrated in FIG. 6A, the driving control circuit 200 includes an input terminal IIN and an output terminal OUTT; the input terminal IIN of the driving control circuit 200 is connected to an output terminal of a power supply of the display device, and is configured to receive an input voltage VIN provided by the power supply; the output terminal OUTT of the driving control circuit 200 is connected to, for example, a power integrated circuit of the display device, and is configured to provide the input voltage VIN to the power integrated circuit, for example, in a case of no power-off and then quick power-on. In a case where the display device is powered off and then quickly powered on, the driving control circuit 200 can prevent the input voltage VIN from being transmitted to the output terminal OUTT (in this case, the output terminal OUTT outputs, for example, a voltage of 0 V), thereby reducing the risk of poor display of the display device equipped with the driving control circuit 200.

As illustrated in FIG. 6A, the driving control circuit 200 further includes a threshold voltage generation circuit 235, a voltage sensing circuit 234, a first comparison circuit 231, a power-down time acquisition circuit 210, a second comparison circuit 232, a judgment circuit 233, and a switch circuit 220.

As illustrated in FIG. 6A, the voltage sensing circuit 234 provides the sensed voltage value to the first comparison circuit 231 and the power-down time acquisition circuit 210. For example, the voltage sensing circuit 234 may be configured as a voltage sampling circuit; the threshold voltage generation circuit 235 is configured to generate a threshold voltage UVLO, and provide the threshold voltage UVLO to the first comparison circuit 231. For example, the threshold voltage generation circuit 235 may include one or more voltage dividing resistors to obtain the threshold voltage based on the input voltage, and the threshold voltage generation circuit 235 also includes one or more capacitors to store the threshold voltage.

For example, the first comparison circuit 231 may be a comparator or an operational amplifier. For example, as illustrated in FIG. 6A, a first terminal of the first comparison circuit 231 is connected to the voltage sensing circuit 234, and is configured to receive the input voltage VIN (i.e., a value of the input voltage VIN); a second terminal of the first comparison circuit 231 is connected to the threshold voltage generation circuit 235, and is configured to receive the threshold voltage UVLO (i.e., a value of the threshold voltage); the first comparison circuit 231 is configured to compare the input voltage VIN with the threshold voltage UVLO to obtain a voltage comparison result, an output terminal of the first comparison circuit 231 is configured to output the voltage comparison result. In a case where the input voltage VIN is less than the threshold voltage UVLO, the output terminal of the first comparison circuit 231 is configured to output a first voltage comparison result (for example, to output 0); and in a case where the input voltage VIN is greater than or equal to the threshold voltage UVLO, the output terminal of the first comparison circuit 231 is configured to output a second voltage comparison result (for example, to output 1).

It should be noted that, in this example and other examples of the embodiments of the present disclosure, the driving control circuit 200 may not be provided with the threshold voltage generation circuit 235. In this case, a value corresponding to the threshold voltage UVLO may be pre-stored in a memory, and the first comparison circuit 231 may read the threshold voltage UVLO from the memory when comparing the input voltage VIN with the threshold voltage UVLO.

As illustrated in FIG. 6A, the power-down time acquisition circuit 210 is configured to detect the power-down time period Td required for the input voltage VIN to decrease to the lowest voltage (i.e., to the point C). For a specific implementation of the power-down time acquisition circuit 210 illustrated in FIG. 6A, reference may be made to the power-down time acquisition circuit 110 illustrated in FIGS. 3A and 5, and details are not described herein again.

As illustrated in FIG. 6A, a first terminal of the second comparison circuit 232 is connected to the output terminal of the power-down time acquisition circuit 210, and is configured to receive the power-down time period Td; a second terminal of the second comparison circuit 232 is configured to receive the threshold power-down time period Tth; the second comparison circuit 232 is configured to compare the power down time period Td with the threshold power down time period Tth to obtain a power-down time comparison result; an output terminal of the second comparison circuit 232 is configured to output the power-down time comparison result. For example, in a case where the power-down time period Td is less than the threshold power-down time period Tth, the output terminal of the second comparison circuit 232 is configured to output a first power-down time comparison result (for example, to output 0); and in a case where the power-down time period Td is greater than or equal to the threshold power-down time period Tth, the output terminal of the second comparison circuit 232 is configured to output a second power-down time comparison result (for example, to output 1).

For example, the second comparison circuit 232 may be a comparator or an operational amplifier. For example, for a specific implementation of the second comparison circuit 232, reference may be made to the examples illustrated in FIG. 3A and FIG. 5, and details are not described herein again.

As illustrated in FIG. 6A, a first terminal of the judgment circuit 233 is connected to the output terminal of the first comparison circuit 231, and is configured to receive the voltage comparison result; a second terminal of the judgment circuit 233 is connected to the output terminal of the second comparison circuit 232, and is configured to receive the power-down time comparison result; the judgment circuit 233 is configured to generate a switch control signal according to the voltage comparison result and the power-down time comparison result; an output terminal OUTT of the judgment circuit 233 is configured to output the switch control signal. For example, the judgment circuit 233 is configured to generate, according to the first voltage comparison result and the first power-down time comparison result, a first switch control signal to turn off the switch circuit 220, and generate, according to the second voltage comparison result or the second power-down time comparison result, a second switch control signal to turn on the switch circuit 220.

For example, the judgment circuit 233 may be a dedicated or general-purpose circuit or chip with a judgment function, for example, may be implemented as an OR gate logic device; for example, in a case where the input voltage VIN is less than the threshold voltage UVLO and the power-down time period Td is less than the threshold power-down time period Tth, the judgment circuit 233 is configured to receive the first voltage comparison result and the first power-down time comparison result (that is, both the output terminal of the first comparison circuit 231 and the output terminal of the second comparison circuit 232 output 0), and the output terminal OUTT of the judgment circuit 233 is configured to output the first switch control signal (for example, to output 0); and in a case where the input voltage VIN is greater than or equal to the threshold voltage UVLO or the power-down time period Td is greater than or equal to the threshold power-down time period Tth, the judgment circuit 233 is configured to receive at least one selected from a group consisting of the second voltage comparison result and the second power-down time comparison result (for example, at least one of the output terminal of the first comparison circuit 231 and the output terminal of the second comparison circuit 232 outputs 1), and the output terminal OUTT of the judgment circuit 233 is configured to output the second switch control signal (for example, to output 1).

As illustrated in FIG. 6A, a control terminal of the switch circuit 220 is configured to be connected to the output terminal of the judgment circuit 233 to receive the switch control signal output by the judgment circuit 233, a first terminal of the switch circuit 220 is configured to be connected to the input terminal IIN to receive the input voltage VIN, a second terminal of the switch circuit 220 is configured to be connected to the output terminal OUTT, and the switch circuit 220 is configured to determine, according to the switch control signal, whether to be turned on to transmit the input voltage VIN from the input terminal IIN to the output terminal OUTT for output.

For example, in a case where the control terminal of the switch circuit 220 receives the first switch signal, the switch circuit 220 is turned off. In this case, the input voltage VIN received from the input terminal IIN of the driving control circuit cannot be transmitted to the output terminal OUTT of the driving control circuit, and therefore cannot be output from the output terminal OUTT of the driving control circuit. For another example, in a case where the control terminal of the switch circuit 220 receives the second switch signal, the switch circuit 220 circuit is turned on. In this case, the input voltage VIN received by the input terminal IIN of the driving control circuit can be transmitted to the output terminal OUTT of the driving control circuit for output. For example, the switch circuit 220 may be a transistor.

It should be noted that, although in the example illustrated in FIG. 6A, the first comparison circuit 231 and the power-down time acquisition circuit 210 use the value of the input voltage VIN provided by the same voltage sensing circuit 234, but the embodiments of the present disclosure are not limited thereto. For example, according to actual requirements, the driving control circuit may also be provided with two voltage sensing circuits to provide the values of the input voltages VIN to the first comparison circuit 231 and the power-down time acquisition circuit 210, respectively. In this case, the first comparison circuit 231 can be integrated with a corresponding voltage sensing circuit, and the power-down time acquisition circuit 210 can be integrated with a corresponding voltage sensing circuit.

Figure 6B:
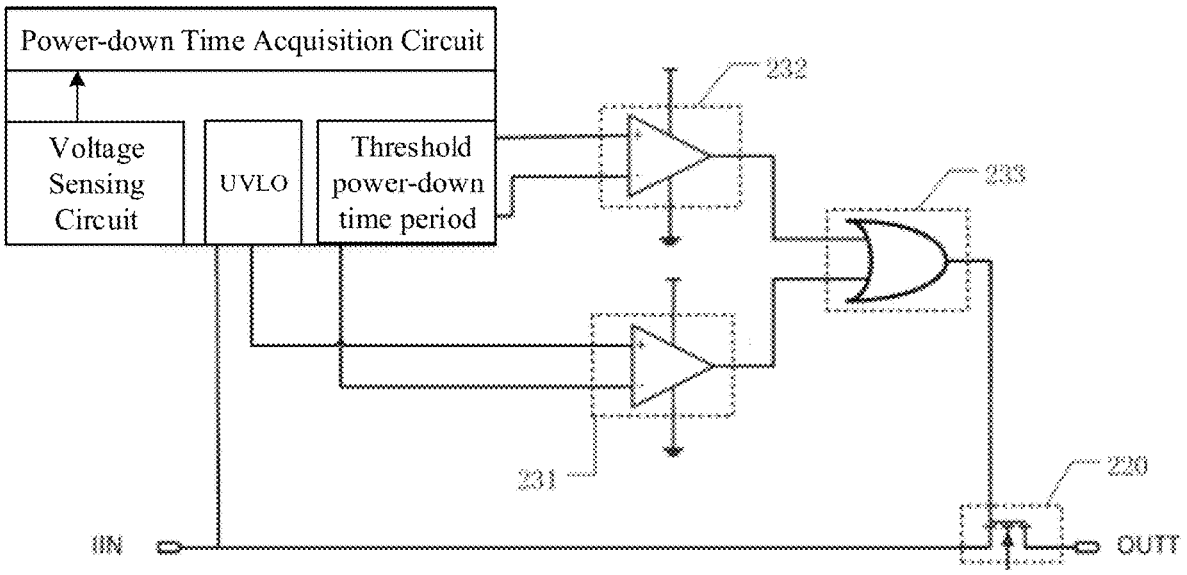
FIG. 6B is a schematic diagram of yet another driving control circuit provided by at least one embodiment of the present disclosure.

FIG. 6B is a schematic diagram illustrating still another driving control circuit 200 (i.e., the driving control circuit 200 illustrated in FIG. 6A) provided by an embodiment of the present disclosure. As illustrated in FIG. 6B, the first comparison circuit 231 and the second comparison circuit 232 are implemented as a first comparator and a second comparator, respectively, the judgment circuit 233 is implemented as an OR logic device, and the switch circuit 220 is implemented as a MOS transistor (N type), the power-down time acquisition circuit 210 and the voltage sensing circuit 234 are implemented by the same logic control integrated circuit (IC) or single-chip microcomputer, and the threshold voltage UVLO and the threshold power-down time period Tth of the input voltage VIN are stored in the logic control integrated circuit; in this case, the driving control circuit 200 is not provided with a threshold voltage generation circuit.

As illustrated in FIG. 6B, the input terminal IIN of the driving control circuit 200 is connected to an input terminal of the voltage sensing circuit 234 and a first electrode of the MOS transistor, and provides the input voltage VIN to the input terminal of the voltage sensing circuit 234 and the first electrode of the MOS transistor.

As illustrated in FIG. 6B, an output terminal of the voltage sensing circuit 234 is connected to the input terminal of the power-down time acquisition circuit 210 and a first input terminal of the first comparator, and provides a voltage value of the input voltage VIN to the input terminal of the power-down time acquisition circuit 210 and the first input terminal of the first comparator.

As illustrated in FIG. 6B, a second input terminal of the first comparator reads the threshold voltage UVLO of the input voltage VIN, the first comparator obtains a voltage comparison result by comparing the input voltage VIN with the threshold voltage UVLO, and the voltage comparison result is output via an output terminal of the first comparator. For example, in a case where the input voltage VIN is greater than or equal to the threshold voltage UVLO, the output terminal of the first comparator outputs 1; and in a case where the input voltage VIN is less than the threshold voltage UVLO, the output terminal of the first comparator outputs 0.

As illustrated in FIG. 6B, the power-down time acquisition circuit 210 is configured to detect the power-down time period Td required for the input voltage VIN to decrease to the lowest voltage, and the power-down time period Td is output from the output terminal of the power-down time acquisition circuit 210.

As illustrated in FIG. 6B, the first input terminal of the second comparator is connected to the output terminal of the power-down time acquisition circuit 210 to receive the power-down time period Td; the second input terminal of the second comparator is configured to read the threshold power-down time period Tth; the second comparator is configured to compare the power-down time period Td with the threshold power-down time period Tth to obtain the power-down time comparison result, for example, in a case where the power-down time period Td is greater than or equal to the threshold power-down time period Tth, the second comparator outputs 1; and in a case where the power-down time period Td is less than the threshold power-down time period Tth, the second comparator outputs 0.

As illustrated in FIG. 6B, a first input terminal of the OR gate logic device is connected to the output terminal of the first comparator to receive the voltage comparison result; a second input terminal of the OR gate logic device is connected to the output terminal OUTT of the second comparator to receive the power-down time comparison result; the OR gate logic device generates a switch control signal according to the voltage comparison result and the power-down time comparison result. For example, in a case where a value of the voltage comparison result and a value of the power-down time comparison result both are zero, the OR gate logic device outputs 0; and in a case where at least one of the value of the voltage comparison result and the value of the power-down time comparison result is 1, the OR gate logic device outputs 1.

As illustrated in FIG. 6B, an output terminal of the OR gate logic device is connected to a gate electrode of the MOS transistor, and provides the switch control signal to the gate electrode of the MOS transistor. In a case where the input voltage VIN is less than the threshold voltage UVLO and the power-down time period Td is less than the threshold power-down time period Tth, the values of the voltage comparison result and the power-down time comparison result are zero, the OR gate logic device outputs 0, and the MOS transistor is turned off, so that the input voltage VIN received by the first electrode of the MOS transistor cannot be transmitted to the second electrode of the MOS transistor. In this case, the driving control circuit 200 is in a power-off and quick power-on protection mode. In a case where the input voltage VIN is greater than or equal to the threshold voltage UVLO or the power-down time period Td is greater than or equal to the threshold power-down time period Tth, at least one of the values of the voltage comparison result and the power-down time comparison result is 1, the OR gate logic device outputs 1, the MOS transistor is turned on, so that the input voltage VIN received by the first electrode of the MOS transistor can be transmitted to the second electrode of the MOS transistor through the turned-on MOS transistor. In this case, the driving control circuit 200 is not in the power-off and quick power-on mode or exit from the power-off and quick power-on mode.

It should be noted that, for the driving control circuit 200 illustrated in FIG. 6B, according to actual requirements, the first comparator, the second comparator, the OR gate logic device, the MOS transistor, the power-down time acquisition circuit 210, and the voltage sensing circuit 234 can be implemented by the same logic control integrated circuit (IC), and will not be described in detail herein.

In a case where the display device is powered off and then quickly powered on and the input voltage VIN is less than the threshold voltage UVLO, the driving control circuit 200 illustrated in FIGS. 6A and 6B can prevent the input voltage VIN from being transmitted to the output terminal OUTT (in this case, the output terminal OUTT outputs, for example, a voltage of 0V), so that the driving control circuit 200 has a power-off and then quick power-on protection function, and thus, the risk of poor display of the display device equipped with the driving control circuit 200 can be reduced, thereby improving the user experience. In addition, because the judgment circuit 233 generates the switch control signal according to the voltage comparison result and the power-down time comparison result, the driving control circuit 200 can automatically exit the power-off and then quick power-on protection mode in a case where the input voltage VIN returns to above the threshold voltage UVLO, thereby improving the driving stability and further improving the user experience.

Figure 7A:
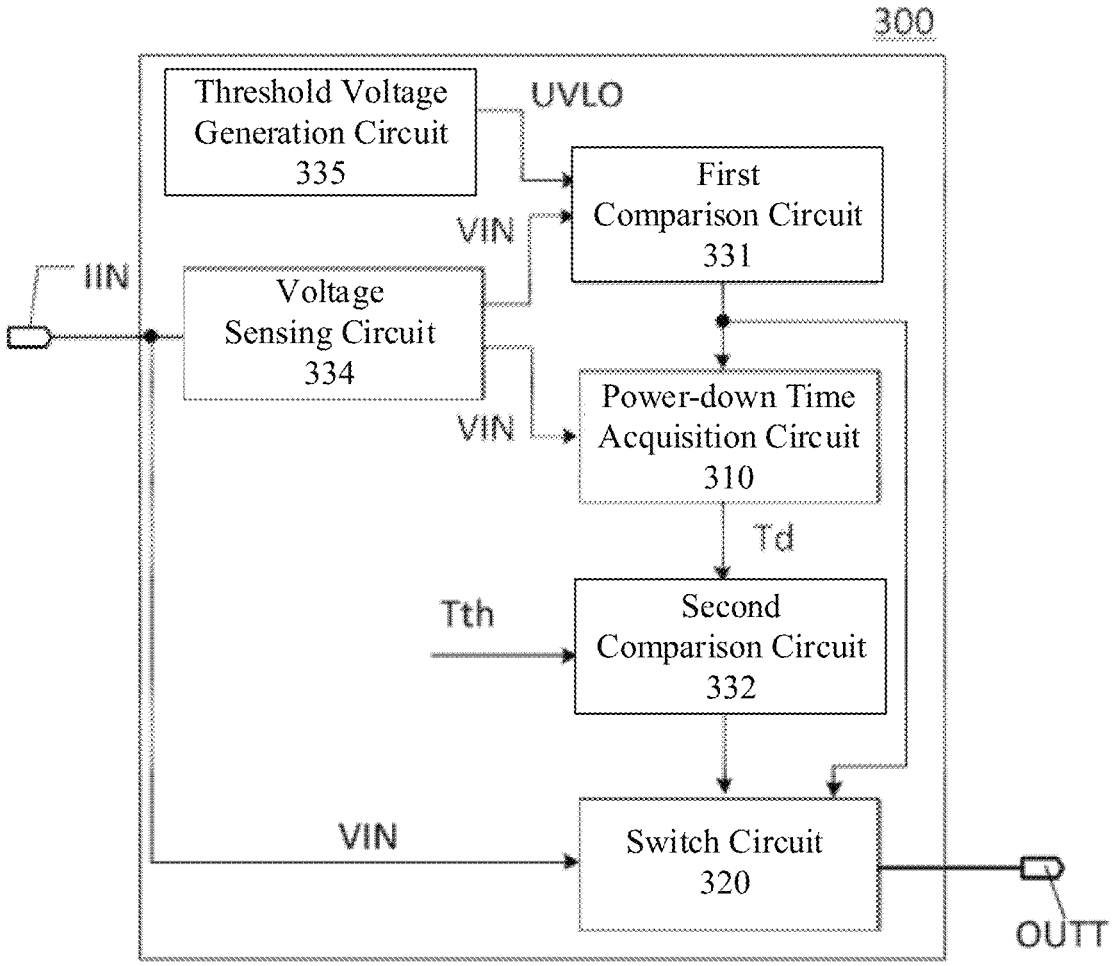
FIG. 7A is an exemplary block diagram of yet another driving control circuit provided by at least one embodiment of the present disclosure.

FIG. 7A is a schematic block diagram illustrating yet another driving control circuit 300 provided by an embodiment of the present disclosure. The driving control circuit 300 can be applied to a display device (for example, the display device illustrated in FIG. 14). As illustrated in FIG. 7A, the driving control circuit 300 includes an input terminal IIN and an output terminal OUTT; the input terminal IIN of the driving control circuit 300 is connected to an output terminal of a power supply of the display device, and is configured to receive an input voltage VIN; an output terminal OUTT of the driving control circuit 300 is connected to, for example, a power integrated circuit of the display device, and is configured to provide the input voltage VIN to the power integrated circuit in a case where there is no power-off and then quick power-on. In a case of power-off and then quick power-on, the driving control circuit 300 can prevent the input voltage VIN from being transmitted to the output terminal OUTT (in this case, the output terminal OUTT outputs, for example, a voltage of 0V), thereby reducing the risk of poor display of the display device equipped with the driving control circuit 300.

As illustrated in FIG. 7A, the driving control circuit 300 further includes a threshold voltage generation circuit 335, a voltage sensing circuit 334, a first comparison circuit 331, a power-down time acquisition circuit 310, a second comparison circuit 332, and a switch circuit 320.

As illustrated in FIG. 7A, the voltage sensing circuit 334 provides the sensed voltage value to the first comparison circuit 331 and the power-down time acquisition circuit 310. For example, the voltage sensing circuit 334 may be configured as a voltage sampling circuit; and the threshold voltage generation circuit 335 is configured to generate a threshold voltage UVLO, and provide the threshold voltage UVLO to the first comparison circuit 331.

As illustrated in FIG. 7A, a first terminal of the first comparison circuit 331 is connected to the voltage sensing circuit 334, and is configured to receive the input voltage VIN; a second terminal of the first comparison circuit 331 is connected to the threshold voltage generation circuit 335, and is configured to receive the threshold voltage UVLO; the first comparison circuit 331 is configured to compare the input voltage VIN with the threshold voltage UVLO to obtain a voltage comparison result; an output terminal of the first comparison circuit 331 is configured to output the voltage comparison result. In a case where the input voltage VIN is less than the threshold voltage UVLO, the output terminal of the first comparison circuit 331 is configured to output a first voltage comparison result (for example, to output 0); and in a case where the input voltage VIN is greater than or equal to the threshold voltage UVLO, the output terminal of the first comparison circuit 331 is configured to output a second voltage comparison result (for example, to output 1). For example, the first comparison circuit 331 may be a comparator or an operational amplifier.

As illustrated in FIG. 7A, the power-down time acquisition circuit 310 is connected to the output terminal of the first comparison circuit 331, and is triggered by the first voltage comparison result (for example, a low-level signal) to detect a power-down time period Td, that is, the power-down time acquisition circuit 310 detects the power-down time period Td only in a case where the first comparison circuit 331 outputs the first voltage comparison result. In this case, the judgment circuit is no longer necessary, and the detecting of the power-down time period is not performed in a case where the first comparison circuit 331 outputs the second voltage comparison result (i.e., in a case where the input voltage VIN is greater than or equal to the threshold voltage UVLO), which can reduce the calculation amount of the driving control circuit 100, and can simplify the structure of the driving control circuit 100.

As illustrated in FIG. 7A, the power-down time acquisition circuit 310 is configured to detect the power-down time period Td required for the input voltage VIN to decrease to the lowest voltage. For a specific implementation of the power-down time acquisition circuit 310 illustrated in FIG. 7A, reference may be made to the examples illustrated in FIGS. 3A and 5, and details are not described herein again.

As illustrated in FIG. 7A, a first terminal of the second comparison circuit 332 is connected to the power-down time acquisition circuit 310, and is configured to receive the power-down time period Td; a second terminal of the second comparison circuit 332 is configured to receive a threshold power-down time period Tth; the second comparison circuit 332 is configured to compare the power-down time period Td with the threshold power-down time period Tth to obtain a power-down time comparison result; an output terminal of the second comparison circuit 332 is configured to output a switch control signal. For example, in a case where the power-down time period Td is less than the threshold power-down time period Tth, the second comparison circuit 332 obtains a first power-down time comparison result, and the output terminal of the second comparison circuit 332 is configured to output a first switch control signal (a switch control signal used for turning off the switch circuit 320); and in a case where the power-down time period Td is greater than or equal to the threshold power-down time period Tth, the second comparison circuit 332 obtains a second power-down time comparison result, and the output terminal of the second comparison circuit 332 outputs a second switch control signal (a switch control signal used for turning on the switch circuit 320). For example, for a specific implementation of the second comparison circuit 332, reference may be made to the examples illustrated in FIG. 3A and FIG. 5, and details are not described herein again.

The switch circuit 320 is configured to determine, according to the switch control signal, whether to be turned on to transmit the input voltage VIN to the output terminal OUTT for output.

Figure 7B:
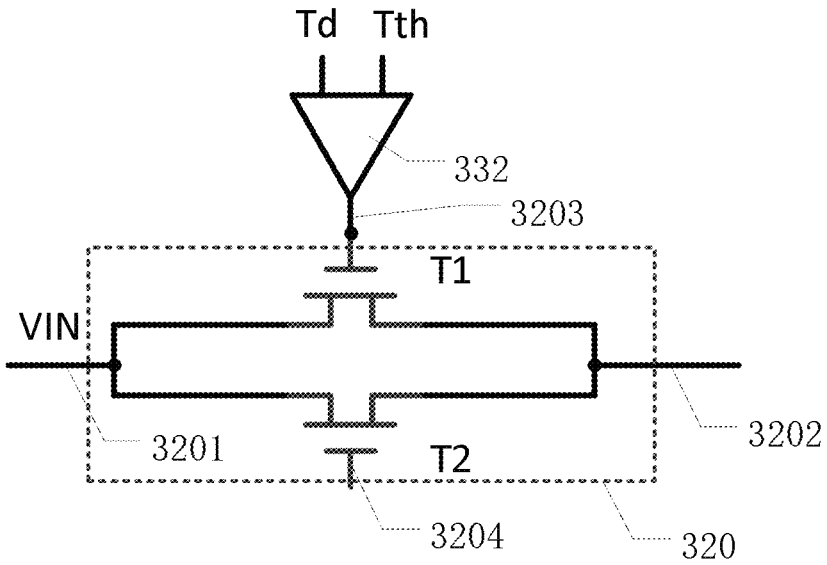
FIG. 7B is a schematic structural diagram of a switch circuit and a second comparison circuit illustrated in FIG. 7A.

FIG. 7B is a schematic structural diagram illustrating the switch circuit and the second comparison circuit illustrated in FIG. 7A; as illustrated in FIG. 7B, the switch circuit 320 includes a first transistor T1, a second transistor T2, a first control terminal 3203, a second control terminal 3204, an input terminal 3201, and an output terminal 3202; a control terminal, a first terminal, and a second terminal of the first transistor T1 are respectively configured as the first control terminal 3203, the input terminal 3201, and the output terminal 3202 of the switch circuit 320, a first terminal and a second terminal of the second transistor T2 are respectively connected to the input terminal 3201 and the output terminal 3202 of the switch circuit 320, and a control terminal of the second transistor T2 is configured as the second control terminal 3204 of the switch circuit 320.

As illustrated in FIGS. 7A and 7B, the first control terminal 3203 of the switch circuit 320 is configured to receive the switch control signal output by the second comparison circuit 332; the second control terminal 3204 of the switch circuit 320 is configured to receive a switch control signal corresponding to a voltage comparison result output by the first comparison circuit 331; the input terminal of the switch circuit 320 is configured to receive the input voltage VIN; the output terminal of the switch circuit 320 is configured to be connected to the output terminal OUTT.

In a case where the first comparison circuit 331 outputs the first voltage comparison result (for example, a low-level signal), the power-down time acquisition circuit 310 detects the power-down time period Td, whereby the second comparison circuit 332 provides the switch control signal to the first control terminal 3203 of the switch circuit 320.

In a case where the second comparison circuit 332 provides the second switch control signal (for example, a high-level signal), the first transistor T1 is turned on; and in a case where the second comparison circuit 332 provides the first switch control signal (for example, a low-level signal), the first transistor T1 is turned off. Because the second control terminal 3204 of the switch circuit 320 receives the first voltage comparison result (for example, a low-level signal) in this case, the second transistor T2 is turned off. Therefore, in the case where the second comparison circuit 332 provides the second switch control signal, the switch circuit 320 is turned on, and the input voltage VIN received by the input terminal IIN of the driving control circuit can be transmitted to the output terminal OUTT of the driving control circuit for output; and in the case where the first comparison circuit 332 provides the first switch control signal, the switch circuit 320 is turned off, and the input voltage VIN received by the input terminal IIN of the driving control circuit cannot be transmitted to the output terminal OUTT of the driving control circuit, and therefore cannot be output from the output terminal OUTT of the driving control circuit.

Therefore, the switch circuit 320 can be configured to determine, according to the switch control signal, whether to be turned on to transmit the input voltage VIN to the output terminal OUTT for output, which reduces the risk of poor display of the display device equipped with the driving control circuit 300, thereby improving the user experience.

In a case where the first comparison circuit 331 outputs the second voltage comparison result (for example, a high-level signal), the second voltage comparison result causes the power-down time acquisition circuit 310 not to detect the power-down time period Td. In this case, the first control terminal 3203 of the switch circuit 320 does not receive the switch control signal; meanwhile, the second control terminal 3204 of the switch circuit 320 receives the switch control signal (for example, a high-level signal) corresponding to the second voltage comparison result, and causes the second transistor T2 to be turned on; in this case, the switch circuit 320 is turned on, and the input voltage VIN received by the input terminal IIN of the driving control circuit can be transmitted to the output terminal OUTT of the driving control circuit for output, that is, the driving control circuit 300 is not in the power-off and then quick power-on mode or exit from the power-off and then quick power-on mode. Therefore, the driving control circuit 300 can automatically exit the power-off and then quick power-on protection mode in a case where the input voltage VIN returns to above the threshold voltage UVLO, thereby improving the driving stability and further improving the user experience.

Figure 8A:
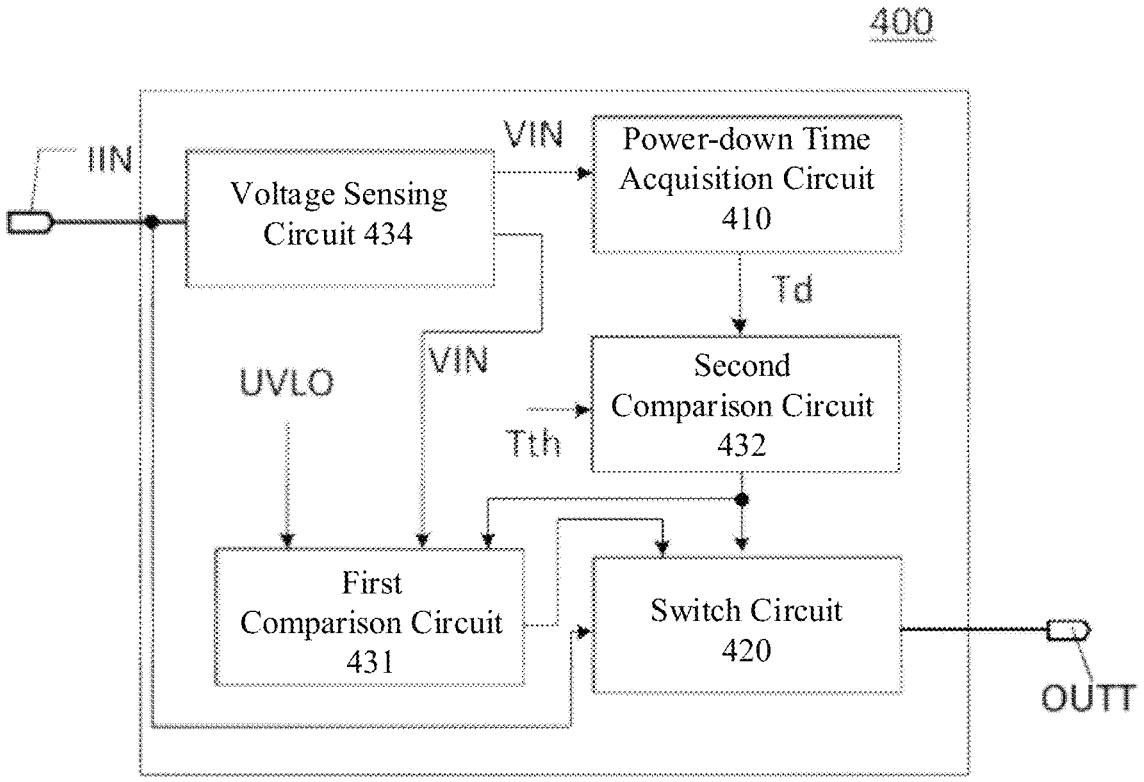
FIG. 8A is an exemplary block diagram of yet another driving control circuit provided by at least one embodiment of the present disclosure.

FIG. 8A is a schematic block diagram illustrating yet another driving control circuit 400 provided by an embodiment of the present disclosure. The driving control circuit 400 can be applied to a display device (for example, the display device illustrated in FIG. 14). As illustrated in FIG. 8A, the driving control circuit 400 includes an input terminal IIN and an output terminal OUTT; the input terminal IIN of the driving control circuit 400 is connected to an output terminal of a power supply of the display device, and is configured to receive an input voltage VIN; an output terminal OUTT of the driving control circuit 400 is connected to, for example, a power integrated circuit of the display device, and is configured to provide the input voltage VIN to the power integrated circuit in a case where there is no power-off and then quick power-on. In a case of power-off and then quick power-on, the driving control circuit 400 can prevent the input voltage VIN from being transmitted to the output terminal OUTT (in this case, the output terminal OUTT outputs, for example, a voltage of 0 V), thereby reducing the risk of poor display of the display device equipped with the driving control circuit 400.

As illustrated in FIG. 8A, the driving control circuit 400 further includes a voltage sensing circuit 434, a first comparison circuit 431, a power-down time acquisition circuit 410, a second comparison circuit 432, and a switch circuit 420.

As illustrated in FIG. 8A, the voltage sensing circuit 434 provides the sensed voltage value to the power-down time acquisition circuit 410. For example, the voltage sensing circuit 434 may be configured as a voltage sampling circuit.

As illustrated in FIG. 8A, the power-down time acquisition circuit 410 is configured to detect a power-down time period Td required for the input voltage VIN to decrease to the lowest voltage. For a specific implementation of the power-down time acquisition circuit 410 illustrated in FIG. 8A, reference may be made to the examples illustrated in FIGS. 3A and 5, and details are not described herein again.

As illustrated in FIG. 8A, a first terminal of the second comparison circuit 432 is connected to the power-down time acquisition circuit 410, and is configured to receive the power-down time period Td; a second terminal of the second comparison circuit 432 is configured to receive a threshold power-down time period Tth; the second comparison circuit 432 is configured to compare the power-down time period Td with the threshold power-down time period Tth to obtain a power-down time comparison result; an output terminal of the second comparison circuit 432 is configured to output a switch control signal. For example, in a case where the power-down time period Td is less than the threshold power-down time period Tth, the second comparison circuit 432 obtains a first power-down time comparison result, and the output terminal of the second comparison circuit 432 is configured to output a first switch control signal (a switch control signal used for turning off the switch circuit 420); and in a case where the power-down time period Td is greater than or equal to the threshold power-down time period Tth, the second comparison circuit 432 obtains a second power-down time comparison result, and the output terminal of the second comparison circuit 432 outputs a second switch control signal (a switch control signal used for turning on the switch circuit 420). For example, for a specific implementation of the second comparison circuit 432, reference may be made to the examples illustrated in FIG. 3A and FIG. 5, and details are not described herein again. For example, the switch control signal output by the second comparison circuit 432 is configured to be provided to the switch circuit 420 and the first comparison circuit 431. For example, the switch control signal output by the second comparison circuit 432 can be used to control whether to trigger the first comparison circuit 431 to operate. For example, in a case where the first comparison circuit 431 receives the first switch control signal (in a case where the power-down time period Td is less than the threshold power-down time period Tth), the first comparison circuit 431 is triggered. In this case, the first comparison circuit 431 outputs the switch control signal based on comparing the input voltage VIN and the threshold voltage UVLO. In a case where the first comparison circuit 431 receives the second switch control signal (in a case where the power-down time period Td is greater than or equal to the threshold power-down time period Tth), the first comparison circuit 431 is not triggered. In this case, the first comparison circuit 431 provides, for example, an invalid signal (i.e., the invalid signal is a signal that causes a transistor or a circuit, which receives the signal, to be turned off).

The switch circuit 420 is configured to determine, according to the switch control signal, whether to be turned on to transmit the input voltage VIN to the output terminal OUTT for output.

Figure 8B:
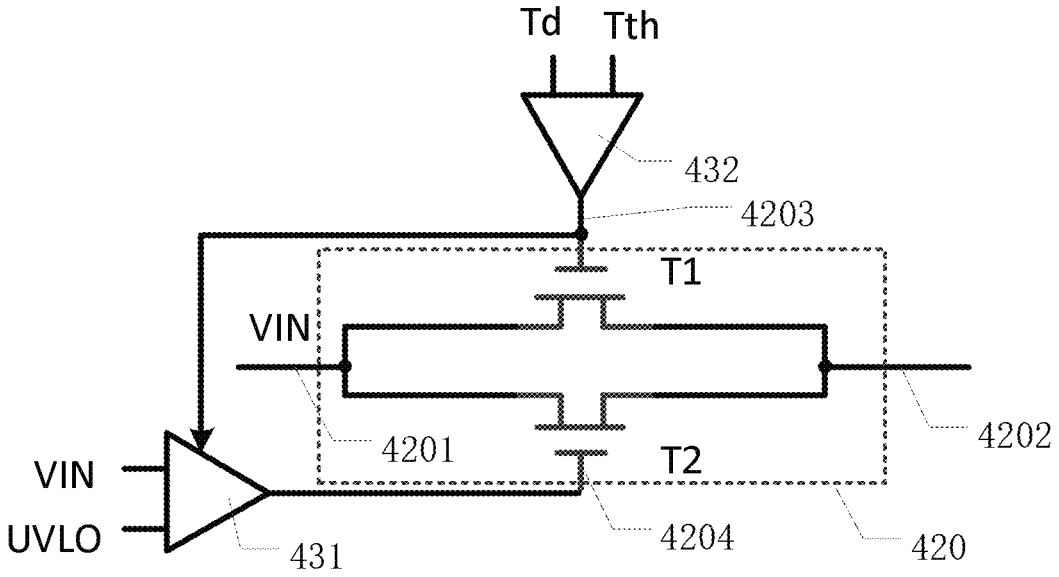
FIG. 8B is a schematic structural diagram of a switch circuit, a first comparison circuit, and a second comparison circuit illustrated in FIG. 8A.

FIG. 8B is a schematic structural diagram illustrating the switch circuit, the first comparison circuit, and the second comparison circuit illustrated in FIG. 8A. As illustrated in FIG. 8B, the switch circuit 420 includes a first transistor T1, a second transistor T2, a first control terminal 4203, a second control terminal 4204, an input terminal 4201, and an output terminal 4202. A control terminal, a first terminal, and a second terminal of the first transistor T1 are respectively configured as the first control terminal 4203, the input terminal 4201, and the output terminal 4202 of the switch circuit 420, a first terminal and a second terminal of the second transistor T2 are respectively connected to the input terminal 4201 and the output terminal 4202 of the switch circuit 420, and a control terminal of the second transistor T2 is configured as the second control terminal 4204 of the switch circuit 420.

As illustrated in FIG. 8B, the first control terminal 4203 of the switch circuit 420 is configured to receive the switch control signal output by the second comparison circuit 432; the second control terminal 4204 of the switch circuit 420 is connected to the first comparison circuit 431 to receive the switch control signal output by the first comparison circuit 431; the input terminal of the switch circuit 420 is configured to receive the input voltage VIN; the output terminal of the switch circuit 420 is configured to be connected to the output terminal OUTT.

In a case where the second comparison circuit 432 outputs the second switch control signal (for example, a high-level signal) (that is, in a case where the power-down time period Td is greater than or equal to the threshold power-down time period Tth), the first transistor T1 is turned on, and the first comparison circuit 431 is not triggered (the second control terminal 4204 of the switch circuit 420 does not receive the switch control signal or receives the invalid signal), and the second transistor T2 is, for example, turned off. In this case, the switch circuit 420 is turned on, and the input voltage VIN received by the input terminal IIN of the driving control circuit can be transmitted to the output terminal OUTT of the driving control circuit and be output.

In a case where the second comparison circuit 432 outputs the first switch control signal (i.e., the low-level signal) (that is, in a case where the power-down time period Td is less than the threshold power-down time period Tth), the first transistor T1 is turned off, and the first comparison circuit 431 is triggered and outputs the switch control signal based on comparing the input voltage VIN and the threshold voltage UVLO, and further controls whether the second transistor is turned on and whether the switch circuit 420 is turned on. As illustrated in FIGS. 8A and 8B, the first terminal of the first comparison circuit 431 is connected to the voltage sensing circuit 434, and is configured to receive the input voltage VIN; the second terminal of the first comparison circuit 431 is configured to receive the threshold voltage UVLO.

In a case where the input voltage VIN is less than the threshold voltage UVLO, the first comparison circuit 431 obtains the first voltage comparison result (for example, outputs 0), and the output terminal of the first comparison circuit 431 is configured to output the first switch control signal. In this case, the second transistor T2 is turned off. Because the first transistor T1 is also turned off, the switch circuit 420 remains turned off, the input voltage VIN received by the input terminal IIN of the driving control circuit cannot be transmitted to the output terminal OUTT of the driving control circuit, and therefore cannot be output from the output terminal OUTT of the driving control circuit. Therefore, in a case of power-off and then quick power-on, the driving control circuit 400 provided by the embodiment of the present disclosure can prevent the input voltage VIN from being transmitted to the output terminal OUTT for output, which reduces the risk of poor display of the display device equipped with the driving control circuit 400, thereby improving the user experience.

In a case where the input voltage VIN is greater than or equal to the threshold voltage UVLO, the first comparison circuit 431 obtains the second voltage comparison result (for example, outputs 1), and the output terminal of the first comparison circuit 431 is configured to output the second switch control signal. In this case, although the first transistor T1 is turned off, the second transistor T2 is turned on, so the switch circuit 420 is turned on again, and the input voltage VIN received by the input terminal IIN of the driving control circuit can be transmitted to the output terminal OUTT of the driving control circuit to output. Therefore, the driving control circuit 400 illustrated in FIG. 8A can exit the power-off and then quick power-on protection state in a case where the input voltage VIN returns to above the threshold voltage UVLO, thereby improving the driving stability and further improving the user experience.

At least one embodiment of the present disclosure also provides a driving control method, and the driving control method comprises: receiving an input voltage; detecting a power-down time period required for the input voltage to decrease to a lowest voltage, and the power-down time being used to generate a switch control signal; and determining, according to the switch control signal, whether to turn on a switch circuit to transmit the input voltage to an output terminal for output. For example, the power-down time period may be a power-down time period required for the input voltage to decrease to the lowest voltage from a threshold voltage.

Figure 9:
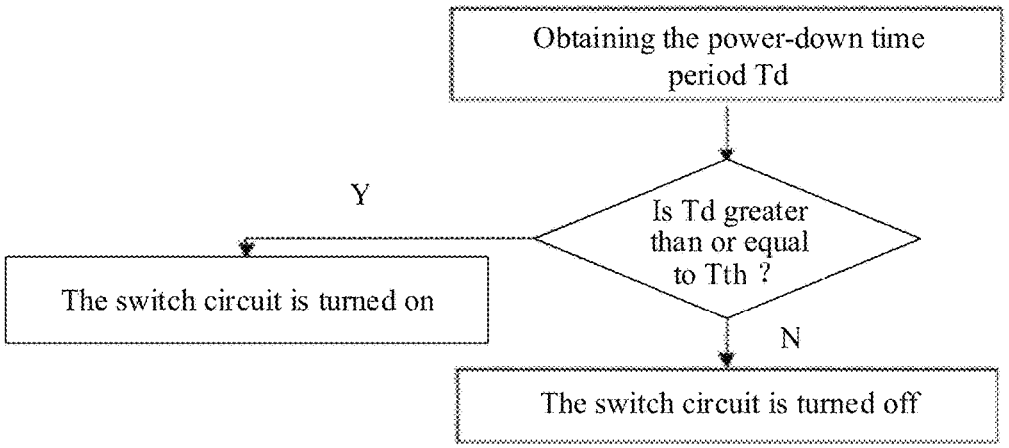
FIG. 9 is an exemplary flowchart of a driving control method provided by at least one embodiment of the present disclosure.

Taking the driving control circuit illustrated in FIG. 5 as an example and in conjunction with FIG. 9, a driving control method provided by at least one embodiment of the present disclosure will be exemplarily described below. FIG. 9 illustrates a driving control method of the driving control circuit illustrated in FIG. 5. As illustrated in FIG. 9, the driving control method includes the following steps.

Step S110: receiving an input voltage VIN (not illustrated in FIG. 9).

Step S120: detecting a power-down time period Td required for the input voltage VIN to decrease to a lowest voltage.

Step S121: comparing the power-down time period Td with a threshold power-down time period Tth, generating a first power-down time comparison result in a case where the power-down time period Td is less than the threshold power-down time period Tth, and outputting a first switch signal; generating a second power-down time comparison result in a case where the power-down time period Td is greater than or equal to the threshold power-down time period Tth, and outputting a second switch signal.

Step S130: determining, according to a switch control signal, whether to turn on a switch circuit to transmit the input voltage VIN to an output terminal OUTT for output.

For example, in step S130, the first switch signal is used to turn off the switch circuit, and the second switch signal is used to turn on the switch circuit.

For example, the driving control method may be performed in the following order: step S110, step S120, step S121, and step S130.

Figure 10A:
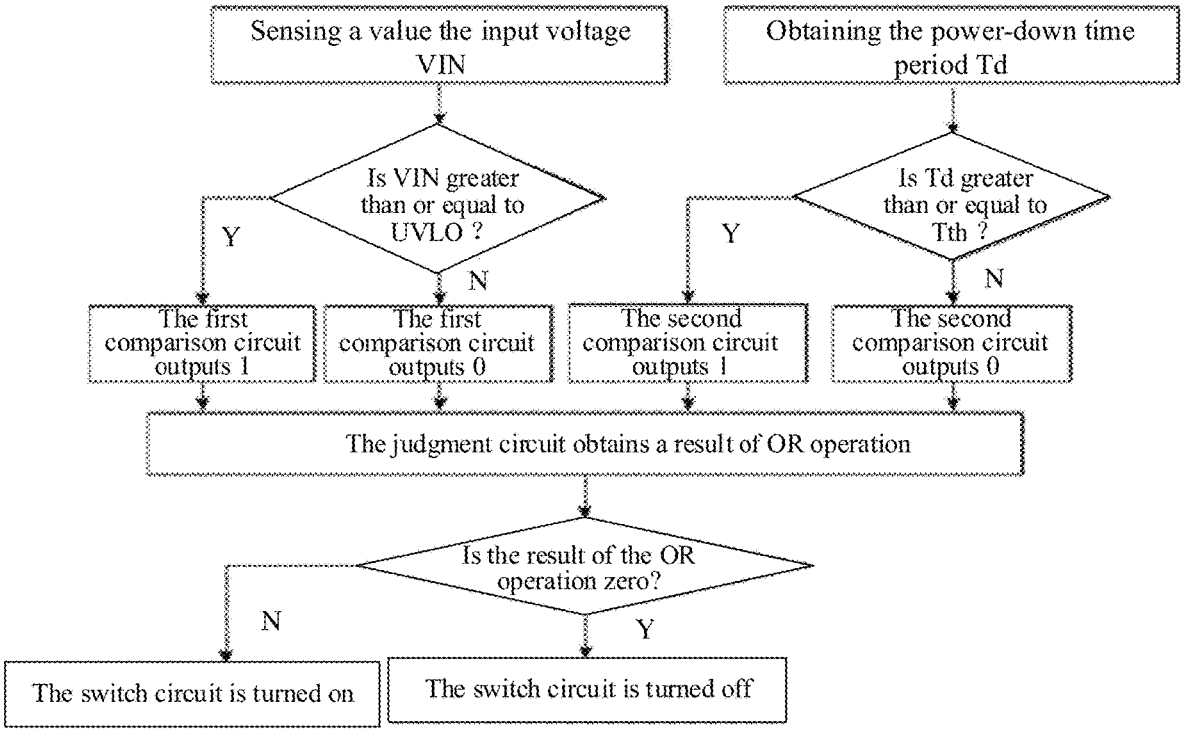
FIG. 10A is an exemplary flowchart of another driving control method provided by at least one embodiment of the present disclosure.

Taking the driving control circuit illustrated in FIG. 6A as an example and in conjunction with FIG. 10A, a driving control method provided by at least one embodiment of the present disclosure will be exemplarily described below. FIG. 10A illustrates a driving control method of the driving control circuit illustrated in FIG. 6A. As illustrated in FIG. 10A, the driving control method includes the following steps.

Step S210: receiving an input voltage VIN (not illustrated in FIG. 10A).

Step S211: sensing (e.g., sensing in real time) a voltage value of the input voltage VIN.

Step S220: detecting a power-down time period Td required for the input voltage VIN to decrease to a lowest voltage.

Step S221: comparing the power-down time period Td with a threshold power-down time period Tth, generating a first power-down time comparison result in a case where the power-down time period Td is less than the threshold power-down time period Tth, and generating a second power-down time comparison result in a case where the power-down time period Td is greater than or equal to the threshold power-down time period Tth.

Step S222: comparing the input voltage VIN with a threshold voltage UVLO, generating a first voltage comparison result in a case where the input voltage VIN is less than the threshold voltage UVLO, and generating a second voltage comparison result in a case where the input voltage VIN is greater than or equal to the threshold voltage UVLO.

Step S223: generating a first switch control signal according to the first voltage comparison result and the first power-down time comparison result to turn off a switch circuit, and generating a second switch control signal according to the second voltage comparison result or the second power-down time comparison result to turn on the switch circuit.

Step S230: determining, according to the switch control signal, whether to turn on the switch circuit to transmit the input voltage VIN to an output terminal OUTT for output.

For example, step S221 and step S222 may be performed in parallel, and the driving control method may be performed in the following order: step S210, step S211, step S220, step S221 (step S222), step S223, and step S230.

Figure 10B:
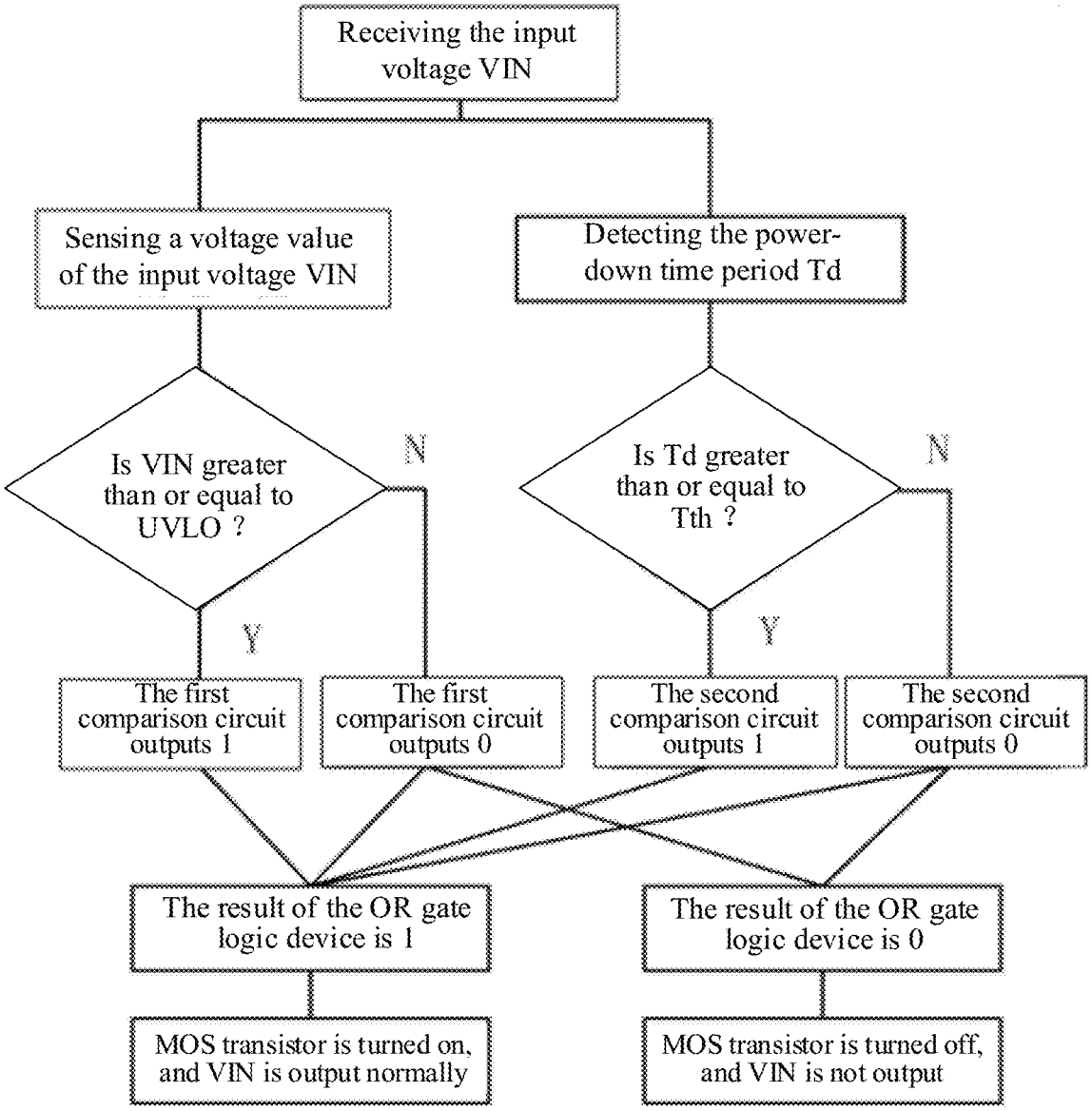
FIG. 10B is an exemplary flowchart of yet another driving control method provided by at least one embodiment of the present disclosure.

Taking the driving control circuit illustrated in FIG. 6B as an example and in conjunction with FIG. 10B, a driving control method provided by at least one embodiment of the present disclosure will be exemplarily described below. FIG. 10B illustrates a driving control method of the driving control circuit illustrated in FIG. 6B. As illustrated in FIG. 10B, the driving control method includes the following steps.

Step S210': receiving an input voltage VIN.

Step S211': sensing (for example, sensing in real-time) a voltage value of the input voltage VIN.

Step S220': detecting a power-down time period Td required for the input voltage VIN to decrease to a lowest voltage.

Step S221': comparing the power-down time period Td with a threshold power-down time period Tth, generating a first power-down time comparison result (outputting 0) in a case where the power-down time period Td is less than the threshold power-down time period Tth, and generating a second power-down time comparison result (outputting 1) in a case where the power-down time period Td is greater than or equal to the threshold power-down time period Tth.

Step S222': comparing the input voltage VIN with a threshold voltage UVLO, generating a first voltage comparison result (outputting 0) in a case where the input voltage VIN is less than the threshold voltage UVLO, and generating a second voltage comparison result (outputting 1) in a case where the input voltage VIN is greater than or equal to the threshold voltage UVLO.

Step S223': generating a first switch control signal (a result output by an OR logic gate is 0) according to the first voltage comparison result and the first power-down time comparison result to turn off a switch circuit, and generating a second switch control signal (a result output by the OR logic gate is 1) according to the second voltage comparison result or the second power-down time comparison result to turn on the switch circuit.

Step S230': determining, according to the switch control signal, whether to turn on the switch circuit to transmit the input voltage VIN to an output terminal OUTT for output (turning off the switch circuit in response to receiving the first switch control signal to prevent the input voltage VIN from being transmitted to the output terminal OUTT).

For example, step S221' and step S222' can be performed in parallel, and the driving control method can be performed in the following order: step S210', step S211', step S220', step S221' (step S222'), step S223', and step S230'.

Figure 11:
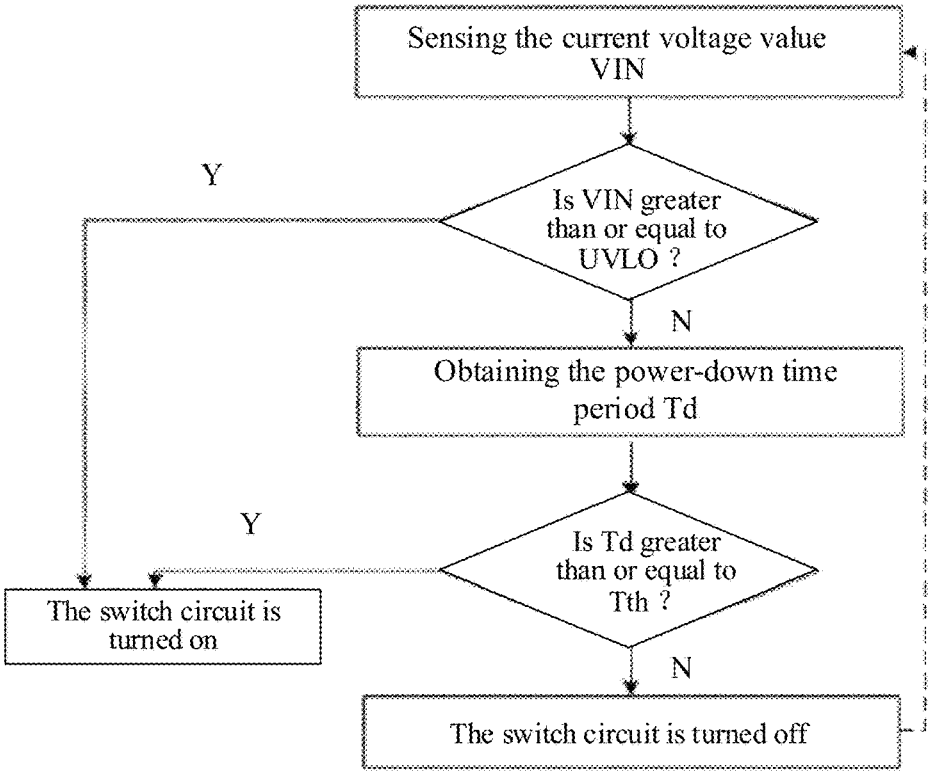
FIG. 11 is an exemplary flowchart of still another driving control method provided by at least one embodiment of the present disclosure.

Taking the driving control circuit illustrated in FIG. 7A as an example and in conjunction with FIG. 11, a driving control method provided by at least one embodiment of the present disclosure will be exemplarily described below. FIG. 11 illustrates a driving control method of the driving control circuit illustrated in FIG. 7A. As illustrated in FIG. 11, the driving control method includes sequentially performing the following steps S310, S311, and S312.

Step S310: receiving an input voltage VIN (not illustrated in FIG. 11).

Step S311: sensing (e.g., sensing in real time) a voltage value of the input voltage VIN.

Step S312: comparing the input voltage VIN with a threshold voltage UVLO, generating a first voltage comparison result in a case where the input voltage VIN is less than the threshold voltage UVLO, and generating a second voltage comparison result in a case where the input voltage VIN is greater than or equal to the threshold voltage UVLO.

In a case where the first voltage comparison result is generated, the following steps S320, S321, and S330 are sequentially performed.

Step S320: detecting a power-down time period Td required for the input voltage VIN to decrease to a lowest voltage.

Step S321: comparing the power-down time period Td with a threshold power-down time period Tth, generating a first power-down time comparison result and a first switch control signal for turning off a switch circuit in a case where the power-down time period Td is less than the threshold power-down time period Tth, and generating a second power-down time comparison result and a second switch control signal for turning on the switch circuit in a case where the power-down time period Td is greater than or equal to the threshold power-down time period Tth.

Step S330: determining, according to the switch control signal, whether to turn on the switch circuit to transmit the input voltage VIN to an output terminal OUTT for output.

In a case where the second voltage comparison result is generated, the second switch control signal is output, and step S330 is directly performed. In this case, there is no need to detect and compare the power-down time period, thereby reducing the amount of calculation.

Figure 12:
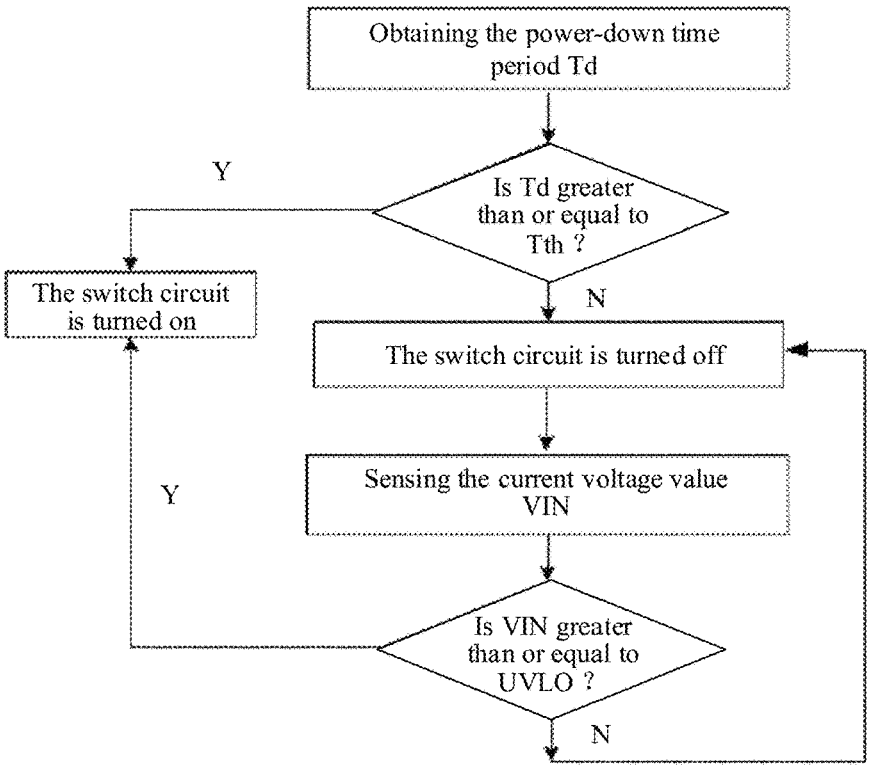
FIG. 12 is an exemplary flowchart of still another driving control method provided by at least one embodiment of the present disclosure.

Taking the driving control circuit illustrated in FIG. 8A as an example and in conjunction with FIG. 12, a driving control method provided by at least one embodiment of the present disclosure will be exemplarily described below. FIG. 12 illustrates a driving control method of the driving control circuit illustrated in FIG. 8A. As illustrated in FIG. 12, the driving control method includes sequentially performing the following steps S410, S420, S421, and S430.

Step S410: receiving an input voltage VIN (not illustrated in FIG. 12).

Step S420: detecting a power-down time period Td required for the input voltage VIN to decrease to a lowest voltage.

Step S421: comparing the power-down time period Td with a threshold power-down time period Tth, generating a first power-down time comparison result in a case where the power-down time period Td is less than the threshold power-down time period Tth, and outputting a first switch control signal; generating a second power-down time comparison result in a case where the power-down time period Td is greater than or equal to the threshold power-down period Tth, and outputting a second switch control signal.

Step S430: determining, according to the switch control signal (the first switch control signal and the second switch control signal generated in step S421 and step S412), whether to turn on a switch circuit to transmit the input voltage VIN to an output terminal OUTT for output.

In a case where the second switch control signal is generated in step S421, the second switch control signal generated in step S421 directly turns on the switch circuit; in a case where the first switch control signal is generated in step S421, the first switch control signal generated in step S421 cannot directly turn on the switch circuit, and the driving control method further includes sequentially performing the following step S411 and step S412.

Step S411: sensing (e.g., sensing in real time) a voltage value of the input voltage VIN.

Step S412: comparing the input voltage VIN with a threshold voltage UVLO, and generating a first voltage comparison result and a first switch control signal for turning off the switch circuit in a case where the input voltage VIN is less than the threshold voltage UVLO, and generating a second voltage comparison result and a second switch control signal for turning on the switch circuit in a case where the input voltage VIN is greater than or equal to the threshold voltage UVLO.

At least one embodiment of the present disclosure also provides a display device, and the display device includes the driving control circuit provided by any embodiment of the present disclosure. For example, the display device may be a liquid crystal display device (e.g., a thin-film-transistor-based liquid crystal display device) or an organic light emitting diode display device (e.g., an active matrix organic light emitting diode display device).

Figure 13:
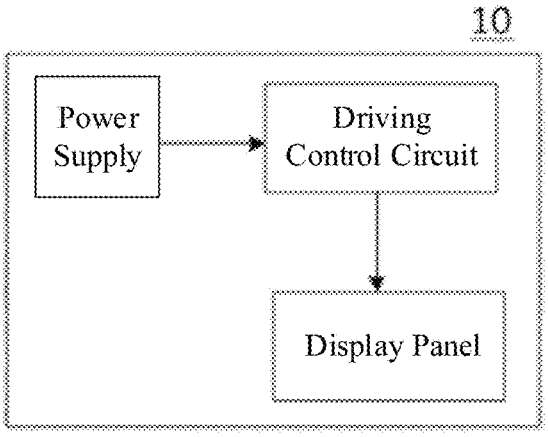
FIG. 13 is an exemplary block diagram of a display device provided by at least one embodiment of the present disclosure.

FIG. 13 is an exemplary block diagram illustrating a display device 10 provided by at least one embodiment of the present disclosure. As illustrated in FIG. 13, the display device includes a power supply that provides an input voltage, a driving control circuit, and a display panel; the driving control circuit may be the driving control circuit 100, the driving control circuit 200, the driving control circuit 300, the driving control circuit 400, or other driving control circuits provided by the embodiments of the present disclosure.

As illustrated in FIG. 13, an input terminal of the driving control circuit is connected to the power supply to receive the input voltage, and an output terminal of the driving control circuit is connected to the display panel, and the driving control circuit is configured to provide the input voltage to a driving circuit of the display panel in a case where there is no power-off and then quick power-on. In a case of power-off and then quick power-on, the driving control circuit can prevent the input voltage from being transmitted to the output terminal. In this case, the input voltage cannot be provided to the display panel, which can reduce the risk of poor display of the display device equipped with the driving control circuit, thereby improving the user experience. In some examples, the driving control circuit can automatically exit the power-off and then quick power-on protection mode in response to the input voltage returning to above the threshold voltage, thereby improving the driving stability and further improving the user experience.

Figure 14:
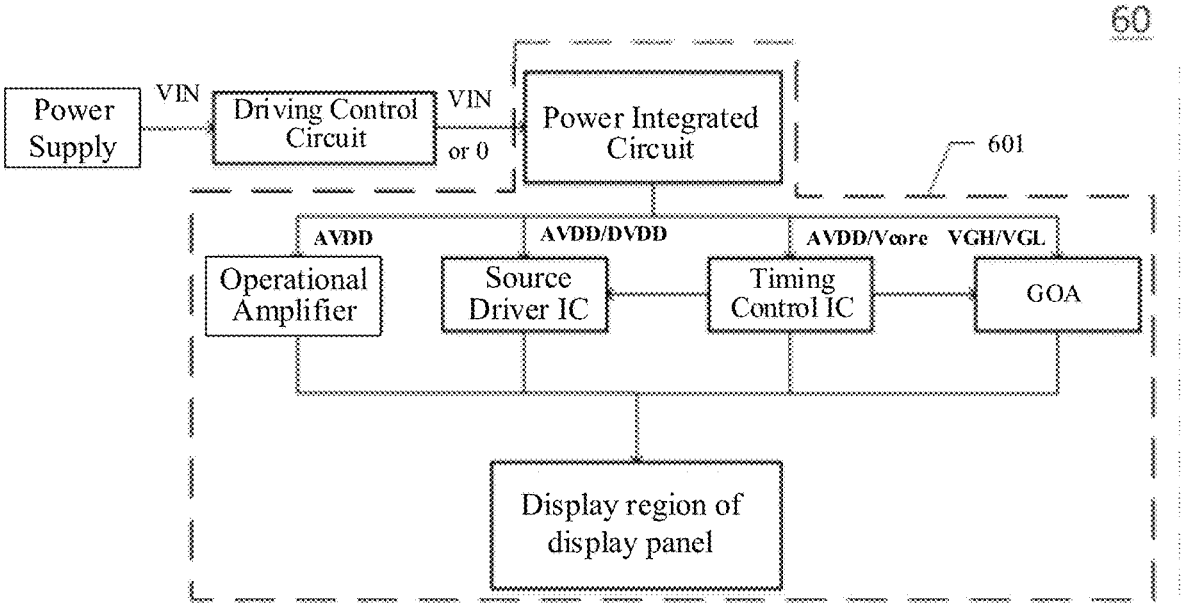
FIG. 14 is an exemplary block diagram of another display device provided by at least one embodiment of the present disclosure.

FIG. 14 is an exemplary block diagram illustrating another display device 60 provided by at least one embodiment of the present disclosure. As illustrated in FIG. 14, the display device 60 includes a power supply and a display panel 601. The display panel 601 of the display device 60 includes a power integrated circuit, an operational amplifier, a source driver integrated circuit (IC), a timing control integrated circuit, a gate driver circuit (GOA) integrated on an array substrate, and a display region (a display array) of the display panel 601. The display region includes, for example, display sub-pixels arranged in an array. The power supply is, for example, a DC power supply, is connected to the power integrated circuit of the display panel, and provides a power signal VIN to the power integrated circuit. The input voltage VIN is, for example, 12V. The power integrated circuit is connected to the operational amplifier, the source driver IC, and the timing control IC, and provides corresponding driving voltages (AVDD, DVDD, Vcore) to the operational amplifier, the source driver IC, and the timing control IC. The power integrated circuit is also connected to the GOA, and can provide a first level (VGH) and a second level (VGL) to the GOA. In another example, the display panel may include a gate driving circuit installed by a bonding method and do not adopt the GOA.

As illustrated in FIG. 14, an input terminal of the driving control circuit is connected to the power supply to receive the input voltage, and an output terminal of the driving control circuit is connected to the power integrated circuit, and the driving control circuit is configured to provide the input voltage to the power integrated circuit in a case where there is no power-off and then quick power-on. In a case of power-off and then quick power-on, the driving control circuit can prevent the input voltage from being transmitted to the output terminal. In this case, the input voltage cannot be provided to the power integrated circuit, which can reduce the risk of poor display of the display device equipped with the driving control circuit, thereby improving the user experience.

It should be noted that other components of the display device (for example, display pixels, gate lines, and data lines) may adopt suitable components, which should be understood by those of ordinary skill in the art, and will not be described herein in detail, nor should they be considered as a limitation to the present disclosure. The display device provided by any embodiment of the present disclosure may be a mobile phone, a tablet computer, a television, a display, a laptop computer, a digital photo frame, a navigator, and any other product or component with a display function.

Although the present disclosure has been described in detail with general description and specific implementations above, it shall be apparent to those skilled in the art that some modifications or improvements may be made on the basis of the embodiments of the present disclosure. Therefore, all the modifications or improvements made without departing from the spirit of the present disclosure shall all fall within the protection scope of the present disclosure.

What are described above are only exemplary implementations of the present disclosure and is not intended to limit the protection scope of the present disclosure; the protection scope of the present disclosure are defined by the appended claims.

What is claimed is:

1. A driving control circuit, comprising:

an input terminal configured to receive an input voltage;

a power-down time acquisition circuit configured to detect a power-down time period required for the input voltage to decrease to a lowest voltage, wherein the power-down time period is used to generate a switch control signal, and the power-down time period is a time difference between a first time point when the input voltage is at the lowest voltage and a second time point, the second time point comprises a time point when the input voltage is at a threshold voltage, or a starting moment of a power-down and then quick power-on;

an output terminal configured to output a voltage;

a switch circuit configured to receive the input voltage and determine, according to the switch control signal, whether to be turned on to transmit the input voltage to the output terminal for output, and a first comparison circuit configured to compare the input voltage with the threshold voltage to obtain a voltage comparison result, wherein the voltage comparison result comprises a first voltage comparison result indicating that the input voltage is less than the threshold voltage and a second voltage comparison result indicating that the input voltage is greater than or equal to the threshold voltage, wherein the power-down time acquisition circuit is configured to detect the power-down time period required for the input voltage to decrease from the threshold voltage to the lowest voltage, wherein the driving control circuit further comprises a second comparison circuit, wherein the second comparison circuit is configured to compare the power-down time period with a threshold power-down time period to obtain a power-down time comparison result, and the power-down time comparison result comprises a first power-down time comparison result indicating that the power-down time period is less than the threshold power-down time period and a second power-down time comparison result indicating that the power-down time period is greater than or equal to the threshold power-down time period.

2. The driving control circuit according to claim 1, further comprising a judgment circuit, wherein the judgment circuit generates the switch control signal according to the voltage comparison result and the power-down time comparison result.

3. The driving control circuit according to claim 2, wherein the judgment circuit is configured to generate, according to the first voltage comparison result and the first power-down time comparison result, a first switch control signal to turn off the switch circuit, and generate, according to the second voltage comparison result or the second power-down time comparison result, a second switch control signal to turn on the switch circuit, the switch control signal comprises the first switch control signal and the second switch control signal.

4. The driving control circuit according to claim 1, wherein the power-down time acquisition circuit is configured to be triggered by the first voltage comparison result to detect the power-down time period.

5. The driving control circuit according to claim 1, further comprising a voltage sensing circuit, wherein the voltage sensing circuit is configured to sense a voltage value of the input voltage, and provide the voltage value to the power-down time acquisition circuit.

6. The driving control circuit according to claim 5, wherein the voltage sensing circuit is further configured to provide the voltage value to the first comparison circuit, and the first comparison circuit compares the voltage value and a pre-stored value of the threshold voltage.

7. The driving control circuit according to claim 1, further comprising a threshold voltage generation circuit, wherein the threshold voltage generation circuit is configured to generate the threshold voltage, wherein a first terminal of the first comparison circuit is configured to receive the input voltage; and a second terminal of the first comparison circuit is configured to receive the threshold voltage.

8. The driving control circuit according to claim 1, wherein the power-down time acquisition circuit comprises a lowest point determination circuit and a time calculation circuit;

the lowest point determination circuit is configured to determine a transition point of the input voltage from negative change to positive change as the lowest voltage, and to output a first time period required for the input voltage to decrease to the lowest voltage; and the time calculation circuit is configured to read a second time period required for the input voltage to decrease to the threshold voltage, and calculate the power-down time period based on the first time period and the second time period.

9. A driving control method, comprising:

receiving an input voltage;

detecting a power-down time period required for the input voltage to decrease to a lowest voltage, wherein the power-down time period is a length of time taken for the input voltage to decrease from a threshold voltage to the lowest voltage, and the power-down time period is used to generate a switch control signal, and the power-down time period is a time difference between a first time point when the input voltage is at the lowest voltage and a second time point, the second time point comprises a time point when the input voltage is at the threshold voltage, or a starting moment of a power-down and then quick power-on;

determining, according to the switch control signal, whether to turn on a switch circuit to transmit the input voltage to an output terminal far output;

comparing the input voltage with the threshold voltage;

generating a first voltage comparison result in a case where the input voltage is less than the threshold voltage; and generating a second voltage comparison result in a case where the input voltage is greater than or equal to the threshold voltage.

10. The driving control method according to claim 9, further comprising:

comparing the power-down time period with a threshold power-down time period, generating a first power-down time comparison result in a case where the power-down time period is less than the threshold power-down time period, and generating a second power-down time comparison result in a case where the power-down time period is greater than or equal to the threshold power-down time period.

11. The driving control method according to claim 10, further comprising:

generating a first switch control signal according to the first voltage comparison result and the first power-down time comparison result to turn off the switch circuit, and generating a second switch control signal according to the second voltage comparison result or the second power-down time comparison result to turn on the switch circuit.

12. The driving control method according to claim 9, wherein in a case where the first voltage comparison result is generated, the detecting the power-down time period is performed again.

13. A display device, comprising a driving control circuit, wherein the driving control circuit comprises:

an input terminal configured to receive an input voltage;

a power-down time acquisition circuit configured to detect a power-down time period required for the input voltage to decrease to a lowest voltage, wherein the power-down time period is used to generate a switch control signal, and the power-down time period is a time difference between a first time point when the input voltage is at the lowest voltage and a second time point, the second time point comprises a time point when the input voltage is at a threshold voltage, or a starting moment of a power-down and then quick power-on;

an output terminal configured to output a voltage;

a switch circuit configured to receive the input voltage and determine, according to the switch control signal, whether to be turned on to transmit the input voltage to the output terminal for output; and a first comparison circuit configured to compare the input voltage with the threshold voltage to obtain a voltage comparison result, wherein the voltage: comparison result comprises a first voltage comparison result indicating that the input voltage is less than the threshold voltage and a second voltage comparison result indicating that the input voltage is greater than or equal to the threshold voltage, wherein the power-down time acquisition circuit is configured to detect the power-down time period required for the input voltage to decrease from the threshold voltage to the lowest voltage, wherein the driving control circuit further comprises a second comparison circuit, wherein the second comparison circuit is configured to compare the power-down time period with a threshold power-down time period to obtain a power-down time comparison result, and the power-down time comparison result comprises a first power-down time comparison result indicating that the power-down time period is less than the threshold power-down time period and a second power-down time comparison result indicating that the power-down time period is greater than or equal to the threshold power-down lime period.

14. The display device according to claim 13, further comprising a display panel and a power supply providing the input voltage, wherein the input terminal of the driving control circuit is connected to the power supply, and the output terminal of the driving control circuit is connected to the display panel.

* * * * *